US008459381B2

(12) United States Patent
Pearce et al.

(10) Patent No.: US 8,459,381 B2
(45) Date of Patent: Jun. 11, 2013

(54) DRILL BITS WITH AXIALLY-TAPERED WATERWAYS

(75) Inventors: Cody A. Pearce, Midvale, UT (US); Michael D. Rupp, Murray, UT (US); Christian M. Lambert, Draper, UT (US)

(73) Assignee: Longyear TM, Inc., South Jordan, UT (US)

( * ) Notice: Subject to any disclaimer, the term of this patent is extended or adjusted under 35 U.S.C. 154(b) by 580 days.

(21) Appl. No.: 12/638,229

(22) Filed: Dec. 15, 2009

(65) Prior Publication Data

US 2010/0089660 A1 Apr. 15, 2010

Related U.S. Application Data

(60) Continuation-in-part of application No. 12/564,779, filed on Sep. 22, 2009, now Pat. No. 7,918,288, which is a continuation of application No. 11/610,680, filed on Dec. 14, 2006, now Pat. No. 7,628,228, application No. 12/638,229, which is a continuation-in-part of application No. 12/564,540, filed on Sep. 22, 2009, now Pat. No. 7,828,090, which is a continuation of application No. 11/610,680, application No. 12/638,229, which is a continuation-in-part of application No. 12/567,477, filed on Sep. 25, 2009, now Pat. No. 7,958,954, which is a division of application No. 11/610,680, application No. 12/638,229, which is a continuation-in-part of application No. 12/568,204, filed on Sep. 28, 2009, now Pat. No. 7,909,119, which is a division of application No. 11/610,680, application No. 12/638,229, which is a continuation-in-part of application No. 12/568,231, filed on Sep. 28, 2009, now Pat. No. 7,874,384, which is a division of application No. 11/610,680.

(51) Int. Cl.
*E21B 10/02* (2006.01)
*E21B 10/48* (2006.01)

(52) U.S. Cl.
USPC ..... 175/403; 408/204

(58) Field of Classification Search
USPC ..... 175/403, 332, 244, 249; 408/204, 408/206, 703
See application file for complete search history.

(56) References Cited

U.S. PATENT DOCUMENTS 367,956 A 8/1887 Brewer
1,572,386 A 2/1926 Gates (Continued)

FOREIGN PATENT DOCUMENTS

WO 0192677 A1 12/2001
WO WO 2004108333 A1 * 12/2004

(Continued)

OTHER PUBLICATIONS

Supplemental Notice of Allowability dated Feb. 23, 2011 from U.S. Appl. No. 12/564,779, filed Sep. 22, 2009 (2 pages).

(Continued)

*Primary Examiner* — Kenneth L Thompson
(74) *Attorney, Agent, or Firm* — Ballard Spahr LLP

(57) ABSTRACT

Implementations of the present invention include drilling tools having axially-tapered waterways that can increase flushing and bit life, while also decreasing clogging. According to some implementations of the present invention, the waterways can be radially tapered in addition to being axially tapered. The axially-tapered waterways can include notches extending into the cutting face of the drilling tools and/or slots enclosed within the crown of the drilling tools. Implementations of the present invention also include drilling systems including drilling tools having axially-tapered waterways, and methods of forming drilling tools having axially-tapered waterways.

28 Claims, 7 Drawing Sheets

U.S. PATENT DOCUMENTS

| | | | | |
|---|---|---|---|---|
| 2,147,843 | A | 2/1939 | Jamar | |
| 2,147,849 | A | 2/1939 | Leo | |
| 2,495,400 | A | 1/1950 | Williams, Jr. | |
| 2,644,672 | A * | 7/1953 | Mathews | 175/307 |
| 2,966,949 | A | 1/1961 | Wepsala, Jr. | |
| 2,969,122 | A | 1/1961 | Steffes | |
| 3,095,935 | A * | 7/1963 | Bridwell et al. | 175/405.1 |
| 3,215,215 | A | 11/1965 | Kellner | |
| RE26,669 | E | 9/1969 | Henderson | |
| 3,495,359 | A | 2/1970 | Smith et al. | |
| 3,692,127 | A * | 9/1972 | Hampe et al. | 175/405.1 |
| 3,860,354 | A * | 1/1975 | Hougen | 408/206 |
| 4,128,136 | A | 12/1978 | Generoux | |
| 4,190,126 | A | 2/1980 | Kabashima | |
| 4,208,154 | A | 6/1980 | Gundy | |
| 4,452,554 | A * | 6/1984 | Hougen | 408/206 |
| 4,499,959 | A | 2/1985 | Grappendorf | |
| 4,538,944 | A * | 9/1985 | Hougen | 408/206 |
| 4,822,757 | A | 4/1989 | Sadamori | |
| 5,025,871 | A | 6/1991 | Stewart | |
| 5,069,584 | A | 12/1991 | Obermeier et al. | |
| D342,270 | S | 12/1993 | Kwang | |
| 5,316,416 | A | 5/1994 | Kim | |
| 5,628,376 | A | 5/1997 | Kleine | |
| 5,823,276 | A | 10/1998 | Beck, III | |
| 5,836,409 | A | 11/1998 | Vail, III | |
| 5,932,508 | A | 8/1999 | Armstrong et al. | |
| 6,123,490 | A * | 9/2000 | Underhill | 408/204 |
| 6,595,844 | B1 | 7/2003 | Mizuno et al. | |
| 6,675,919 | B2 * | 1/2004 | Mosing et al. | 175/402 |
| 7,055,626 | B2 * | 6/2006 | Wells et al. | 175/58 |
| 7,189,036 | B1 | 3/2007 | Watson | |
| 7,341,118 | B2 * | 3/2008 | Viel et al. | 175/245 |
| 7,611,312 | B2 * | 11/2009 | Miyanaga | 408/204 |
| 7,628,228 | B2 | 12/2009 | Drivdahl et al. | |
| 7,641,004 | B2 | 1/2010 | Lapointe | |
| 7,828,090 | B2 | 11/2010 | Drivdahl et al. | |
| 2005/0016775 | A1 | 1/2005 | Hiranuma et al. | |
| 2007/0246266 | A1 | 10/2007 | Larbo | |
| 2008/0142262 | A1 | 6/2008 | Drivdahl et al. | |
| 2009/0283326 | A1 | 11/2009 | Oothoudt | |
| 2010/0006344 | A1 | 1/2010 | Drivdahl et al. | |
| 2010/0012385 | A1 | 1/2010 | Drivdahl et al. | |

FOREIGN PATENT DOCUMENTS

| | | | |
|---|---|---|---|
| WO | 2006004494 | A1 | 1/2006 |
| WO | 2006076795 | A1 | 7/2006 |

OTHER PUBLICATIONS

Issue Notification dated Mar. 16, 2011 from U.S. Appl. No. 12/564,779, filed Sep. 22, 2009 (1 page).
Notice of Allowance dated Feb. 9, 2011 from U.S. Appl. No. 12/567,477, filed Sep. 25, 2009 (6 pages).
Supplemental Notice of Allowability dated Mar. 25, 2011 from U.S. Appl. No. 12/567,477, filed Sep. 25, 2009 (2 pages).
Issue Notification dated Mar. 2, 2011 from U.S. Appl. No. 12/568,204, filed Sep. 28, 2009 (1 page).
Notice of Allowance dated Jun. 1, 2010 from U.S. Appl. No. 29/354,579, filed Jan. 26, 2010 (8 pages).
Office Action dated Jun. 1, 2010 from U.S. Appl. No. 12/567,477, filed Sep. 25, 2009 (21 pages).
Office Action dated Jun. 3, 2010 from U.S. Appl. No. 12/568,231, filed Sep. 28, 2009 (17 pages).
Notice of Allowance dated Jul. 19, 2010 from U.S. Appl. No. 12/564,779, filed Sep. 22, 2009 (8 pages).
Office Action dated Aug. 23, 2010 from U.S. Appl. No. 12/568,204, filed Sep. 28, 2009 (9 pages).
Issue Notification dated Aug. 11, 2010 from U.S. Appl. No. 29/354,579, filed Jan. 26, 2010 (1 page).
Notice of Allowance dated Sep. 1, 2010 from U.S. Appl. No. 12/564,540, filed Sep. 22, 2009 (11 pages).
Office Action dated Sep. 7, 2010 from U.S. Appl. No. 12/564,779, filed Sep. 22, 2009 (12 pages).
Office Action dated Sep. 21, 2010 from U.S. Appl. No. 12/567,477, filed Sep. 25, 2009 (12 pages).
Notice of Allowance dated Aug. 10, 2011 from U.S. Appl. No. 12/909,187, filed Oct. 21, 2010 (5 pages).
Notice of Allowance dated Aug. 4, 2011 from U.S. Appl. No. 29/354,586, filed Jan. 26, 2010 (8 pages).
Notice of Allowance dated Aug. 4, 2011 from U.S. Appl. No. 29/354,592, filed Jan. 26, 2010 (8 pages).
Issue Notification dated Oct. 20, 2010 from U.S. Appl. No. 12/564,540, filed Nov. 9, 2010 (1 page).
Issue Notification dated May 25, 2011 from U.S. Appl. No. 12/567,477, filed Jun. 14, 2011 (1 page).
Issue Notification dated Sep. 28, 2011 from U.S. Appl. No. 29/354,586, filed Jan. 26, 2010 (1 page).
Issue Notification dated Sep. 28, 2011 from U.S. Appl. No. 29/354,592, filed Jan. 26, 2010 (1 page).
Issue Notification dated Oct. 19, 2011 from U.S. Appl. No. 12/909,187, filed Oct. 21, 2010 (1 page).
Office Action dated Oct. 13, 2010 from U.S. Appl. No. 29/354,586, filed Jan. 26, 2010 (19 pages).
Supplemental Notice of Allowability dated Sep. 29, 2010 from U.S. Appl. No. 12/564,540, filed Sep. 22, 2009 (4 pages).
Notice of Allowance dated Sep. 30, 2010 from U.S. Appl. No. 12/568,231, filed Sep. 28, 2009 (15 pages).
Supplemental Notice of Allowance dated May 25, 2011 from U.S. Appl. No. 29/354,586, filed Jan. 26, 2010 (3 pages).
Notice of Allowance dated Apr. 27, 2011 from U.S. Appl. No. 29/354,586, filed Jan. 26, 2010 (7 pages).
Notice of Allowance dated Jun. 2, 2011 from U.S. Appl. No. 12/909,187, filed Oct. 21, 2010 (5 pages).
Notice of Allowance dated Jul. 19, 2011 from U.S. Appl. No. 29/354,592, filed Jan. 26, 2010 (8 pages).
Notice of Allowance dated Nov. 26, 2010 from U.S. Appl. No. 12/568,204, filed Sep. 28, 2009 (13 pages).
Office Action dated Dec. 27, 2010 from U.S. Appl. No. 12/909,187, filed Oct. 21, 2010 (15 pages).
Issue Notification dated Jan. 5, 2011 from U.S. Appl. No. 12/568,231, filed Sep. 28, 2009 (1 page).
Notice of Allowance dated Jan. 21, 2011 from U.S. Appl. No. 12/564,779, filed Sep. 22, 2009 (8 pages).
Issue Notification dated Nov. 18, 2009 from U.S. Appl. No. 11/610,680, filed Dec. 14, 2006 (1 page).
Office Action dated Feb. 25, 2010 from U.S. Appl. No. 12/564,779, filed Sep. 22, 2009 (19 pages).
Office Action dated Mar. 8, 2010 from U.S. Appl. No. 12/568,204, filed Sep. 28, 2009 (18 pages).
Notice of Allowance dated Apr. 5, 2010 from U.S. Appl. No. 29/354,579, filed Jan. 26, 2010 (10 pages).
Office Action dated Apr. 26, 2010 from U.S. Appl. No. 12/564,540, filed Sep. 22, 2009 (7 pages).
Office Action dated Jul. 28, 2008 from U.S. Appl. No. 11/610,680 (7 pages).
Office Action dated Mar. 18, 2009 from U.S. Appl. No. 11/610,680 (7 pages).
Office Action dated Jul. 7, 2009 from U.S. Appl. No. 11/610,680 (6 pages).
International Search Report mailed Aug. 1, 2008 from PCT Application No. PCT/US2007/087619 (2 pages).
Notice of Allowance dated Sep. 30, 2009 from U.S. Appl. No. 11/610,680 (1 page).
Boart Longyear, Alpha Bit, 2003 (1 page).

* cited by examiner

DRILL BITS WITH AXIALLY-TAPERED WATERWAYS

CROSS-REFERENCE TO RELATED APPLICATIONS

This application is a continuation-in-part of prior U.S. patent application Ser. Nos. 12/564,779 and 12/564,540, filed on Sep. 22, 2009, and entitled "DRILL BITS WITH ENCLOSED FLUID SLOTS" and "DRILL BITS WITH ENCLOSED FLUID SLOTS AND INTERNAL FLUTES", respectively, which each are continuations of U.S. patent application Ser. No. 11/610,680, filed Dec. 14, 2006, entitled "CORE DRILL BIT WITH EXTENDED CROWN HEIGHT," which is now U.S. Pat. No. 7,628,228. In addition, this application is also a continuation-in-part of prior U.S. patent application Ser. No. 12/567,477, filed Sep. 25, 2009, entitled, "DRILL BITS WITH ENCLOSED SLOTS", which is a division of U.S. patent application Ser. No. 11/610,680, filed Dec. 14, 2006, entitled "CORE DRILL BIT WITH EXTENDED CROWN HEIGHT," which is now U.S. Pat. No. 7,628,228. Furthermore, this application is a continuation-in-part of prior U.S. patent application Ser. Nos. 12/568,231 and 12/568,204, filed on Sep. 28, 2009, and entitled "DRILL BITS WITH INCREASED CROWN HEIGHT" and "DRILL BITS WITH NOTCHES AND ENCLOSED SLOTS", respectively, which each are divisions of U.S. patent application Ser, No. 11/610,680, filed Dec. 14, 2006, entitled "CORE DRILL BIT WITH EXTENDED CROWN HEIGHT," which is now U.S. Pat. No. 7,628,228. The contents of the above-referenced patent applications and patent are hereby incorporated by reference in their entirety.

BACKGROUND OF THE INVENTION

1. The Field of the Invention

The present invention generally relates to drilling tools that may be used to drill geological and/or manmade formations and to methods of manufacturing and using such drilling tools.

2. Discussion of the Relevant Art

Drill bits and other boring tools are often used to drill holes in rock and other formations for exploration or other purposes. One type of drill bit used for such operations is an impregnated drill bit. Impregnated drill bits include a cutting portion or crown that may be formed of a matrix that contains a powdered hard particulate material, such as tungsten carbide. The hard particulate material may be sintered and/or infiltrated with a binder, such as a copper alloy. Furthermore, the cutting portion of impregnated drill bits may also be impregnated with an abrasive cutting media, such as natural or synthetic diamonds.

During drilling operations, the abrasive cutting media is gradually exposed as the supporting matrix material is worn away. The continuous exposure of new abrasive cutting media by wear of the supporting matrix forming the cutting portion can help provide a continually sharp cutting surface. Impregnated drilling tools may continue to cut efficiently until the cutting portion of the tool is consumed. Once the cutting portion of the tool is consumed, the tool becomes dull and typically requires replacement.

Impregnated drill bits, and most other types of drilling tools, usually require the use of drilling fluid or air during drilling operations. Typically, drilling fluid or air is pumped from the surface through the drill string and across the bit face. The drilling fluid may then return to the surface through a gap between the drill string and the bore-hole wall. Alternatively, the drilling fluid may be pumped down the annulus formed between the drill string and the formation, across the bit face and return through the drill string. Drilling fluid can serve several important functions including flushing cuttings up and out of the bore hole, clearing cuttings from the bit face so that the abrasive cutting media cause excessive bit wear, lubricating and cooling the bit face during drilling, and reducing the friction of the rotating drill string.

To aid in directing drilling fluid across the bit face, drill bits will often include waterways or passages near the cutting face that pass through the drill bit from the inside diameter to the outside diameter. Thus, waterways can aid in both cooling the bit face and flushing cuttings away. Unfortunately, when drilling in broken and abrasive formations, or at high penetration rates, debris can clog the waterways, thereby impeding the flow of drilling fluid. The decrease in drilling fluid traveling from the inside to the outside of the drill bit may cause insufficient removal of cuttings, uneven wear of the drill bit, generation of large frictional forces, burning of the drill bit, or other problems that may eventually lead to failure of the drill bit. Furthermore, frequently in broken and abrasive ground conditions, loose material does not feed smoothly into the drill string or core barrel.

Current solutions employed to reduce clogging of waterways include increasing the depth of the waterways, increasing the width of the waterways, and radially tapering the sides of the waterways so the width of the waterways increase as they extend from the inside diameter to the outside diameter of the drill bit. While each of these methods may reduce clogging and increase flushing to some extent, they also each present various drawbacks to one level or another.

For example, deeper waterways may decrease the strength of the drill bit, reduce the velocity of the drilling fluid at the waterway entrance, and therefore, the flushing capabilities of the drilling fluid, and increase manufacturing costs due to the additional machining involved in cutting the waterways into the blank of the drill bit. Wider waterways may reduce the cutting surface of the bit face, and therefore, reduce the drilling performance of the drill bit and reduce the velocity of the drilling fluid at the waterway entrance. Similarly, radially tapered waterways may reduce the cutting surface of the bit face and reduce the velocity of the drilling fluid at the waterway entrance.

One will appreciate that many of the current solutions may remove a greater percentage of material from the inside diameter of the drill bit than the outside diameter of the drill bit in creating waterways. The reduced bit body volume at the inside diameter may result in premature wear of the drill bit at the inside diameter. Such premature wear can cause drill bit failure and increase drilling costs by requiring more frequent replacement of the drill bit.

Accordingly, there are a number of disadvantages in conventional waterways that can be addressed.

BRIEF SUMMARY OF THE INVENTION

Implementations of the present invention overcome one or more problems in the art with drilling tools, systems, and methods that can provide improved flow of drilling fluid about the cutting face of a drilling tool. For example, one or more implementations of the present invention include drilling tools having waterways that can increase the velocity of drilling fluid at the waterway entrance, and thereby, provide improved flushing of cuttings. In particular, one or more implementations of the present invention include drilling tools having axially-tapered waterways.

For example, one implementation of a core-sampling drill bit can include a shank and an annular crown. The annular crown can include a longitudinal axis, a cutting face, an inner surface, and an outer surface. The annular crown can define an interior space about the longitudinal axis for receiving a core sample. The drill bit can further include at least one waterway extending from the inner surface to the outer surface of the annular crown. The at least one waterway can be axially tapered whereby the longitudinal dimension of the at least one waterway at the outer surface of the annular crown is greater than the longitudinal dimension of the at least one waterway at the inner surface of the annular crown.

Additionally, an implementation of a drilling tool can include a shank and a cutting portion secured to the shank. The cutting portion can include a cutting face, an inner surface, and an outer surface. The drilling tool can also include one or more waterways defined by a first side surface extending from the inner surface to the outer surface of the cutting portion, an opposing second side surface extending from the inner surface to the outer surface of the cutting portion, and a top surface extending between the first side surface and second side surface and from the inner surface to the outer surface of the cutting portion. The top surface can taper from the inner surface to the outer surface of the cutting portion in a direction generally from the cutting face toward the shank.

Furthermore, an implementation of an earth-boring drill bit can include a shank and a crown secured to and extending away from the shank. The crown can include a cutting face, an inner surface, and an outer surface. The drill bit can further include a plurality of notches extending into the cutting face a first distance at the inner surface and extending into the cutting face a second distance at the outer surface. The second distance can be greater than said first distance, and the plurality of notches can extend from the inner surface to the outer surface of the crown.

An implementation of a method of forming a drill bit having axially-tapered waterways can involve forming an annular crown comprised of a hard particulate material and a plurality of abrasive cutting media. The method can also involve placing a plurality of plugs within the annular crown. Each plug of the plurality of plugs can increase in longitudinal dimension along the length thereof from a first end to a second opposing end. The method can additionally involve infiltrating the annular crown with a binder material configured to bond to the hard particulate material and the plurality of abrasive cutting media. Furthermore, the method can involve removing the plurality of plugs from the infiltrated annular crown to expose a plurality of axially-tapered waterways.

In addition to the foregoing, a drilling system can include a drill rig, a drill string adapted to be secured to and rotated by the drill rig, and a drill bit adapted to be secured to the drill string. The drill bit can include a shank and an annular crown. The annular crown can include a longitudinal axis, a cutting face, an inner surface, and an outer surface. The annular crown can define an interior space about the longitudinal axis for receiving a core sample. The annular crown can also include at least one waterway extending from the inner surface to the outer surface. The at least one waterway can be axially tapered whereby the longitudinal dimension of the at least one waterway at the outer surface of the annular crown is greater than the longitudinal dimension of the at least one waterway at the inner surface of the annular crown.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
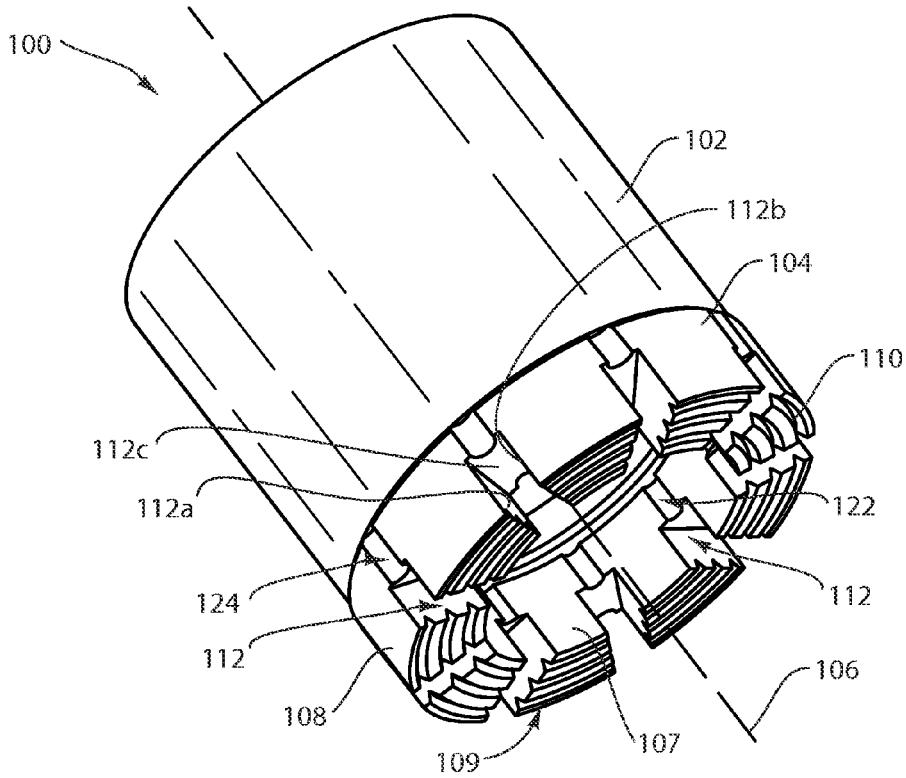
FIG. 1 illustrates a perspective view of a drilling tool including axially-tapered waterways according to an implementation of the present invention.

Implementations of the present invention are directed towards drilling tools, systems, and methods that can provide improved flow of drilling fluid about the cutting face of a drilling tool. For example, one or more implementations of the present invention include drilling tools having waterways that can increase the velocity of drilling fluid at the waterway entrance, and thereby, provide improved flushing of cuttings. In particular, one or more implementations of the present invention include drilling tools having axially-tapered waterways.

One will appreciate in light of the disclosure herein that axially-tapered waterways according to one or more implementations of the present invention can ensure that the opening of the waterway in the inner surface of the drilling tool can is smaller than the opening of the waterway in the outer surface of the drilling tool. Thus, the waterway can act like a nozzle by increasing the velocity of the drilling fluid at the waterway entrance in the inner surface of the drilling tool. The capability of axially-tapered waterways to increase the velocity of the drilling fluid at the waterway entrance can provide increased flushing of cuttings, and can help prevent clogging of the waterways. Furthermore, axially-tapered waterways can provide improved flow of drilling fluid without significantly sacrificing bit body volume at the inside diameter or reducing the cutting surface of the bit face. Thus, the axially-tapered waterways of one or more implementations of the present invention can provide for increased drilling performance and increased drilling life.

In addition, or alternatively, to having axially-tapered waterways, in one or more implementations of the present invention the drilling tools can include axially and radially-tapered waterways, or in other words, double-tapered waterways. One will appreciate in light of the disclosure therein that double-tapered waterways can help ensure that the waterway increases in dimensions in each axis as it extends from the inner surface of the drilling tool to the outer surface of the drilling tool. The increasing size of a double-tapered waterway can reduce the likelihood of debris lodging within the waterway, and thus, increase the drilling performance of the drilling tool.

Furthermore, double-tapered waterways can also allow for a smaller waterway opening at the inside diameter, while still allowing for a large waterway opening at the outside diameter. Thus, one or more implementations of the present invention can increase the amount of matrix material at the inside diameter, and thus, help increase the life of the drill bit while also providing effective flushing. The increased life of such drill bits can reduce drilling costs by reducing the need to trip a drill string from the bore hole to replace a prematurely worn drill bit.

The drilling tools described herein can be used to cut stone, subterranean mineral formations, ceramics, asphalt, concrete, and other hard materials. These drilling tools can include, for example, core-sampling drill bits, drag-type drill bits, roller-cone drill bits, reamers, stabilizers, casing or rod shoes, and the like. For ease of description, the Figures and corresponding text included hereafter illustrate examples of impregnated, core-sampling drill bits, and methods of forming and using such drill bits. One will appreciate in light of the disclosure herein; however, that the systems, methods, and apparatus of the present invention can be used with other drilling tools, such as those mentioned hereinabove.

Figure 2:
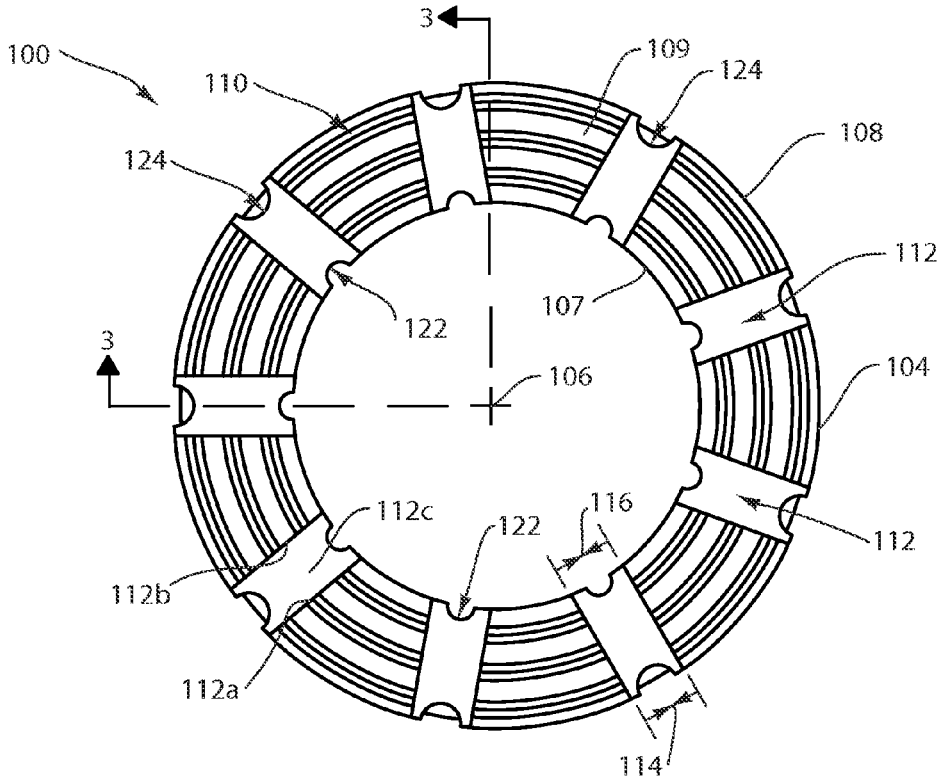
FIG. 2 illustrates a bottom view of the drilling tool of FIG. 1.

Referring now to the Figures, FIGS. 1 and 2 illustrate a perspective view and a top view, respectively, of a drilling tool 100. More particularly, FIGS. 1 and 2 illustrate an impregnated, core-sampling drill bit 100 with axially-tapered waterways according to an implementation of the present invention. As shown in FIG. 1, the drill bit 100 can include a shank or blank 102, which can be configured to connect the drill bit 100 to a component of a drill string. The drill bit 100 can also include a cutting portion or crown 104.

FIGS. 1 and 2 also illustrate that the drill bit 100 can define an interior space about its central axis 106 for receiving a core sample. Thus, both the shank 102 and crown 104 can have a generally annular shape defined by an inner surface 107 and outer surface 108. Accordingly, pieces of the material being drilled can pass through the interior space of the drill bit 100 and up through an attached drill string. The drill bit 100 may be any size, and therefore, may be used to collect core samples of any size. While the drill bit 100 may have any diameter and may be used to remove and collect core samples with any desired diameter, the diameter of the drill bit 100 can range in some implementations from about 1 inch to about 12 inches. As well, while the kerf of the drill bit 100 (i.e., the radius of the outer surface minus the radius of the inner surface) may be any width, according to some implementations the kerf can range from about ¼ inches to about 6 inches.

The crown 104 can be configured to cut or drill the desired materials during the drilling process. In particular, the crown 104 of the drill bit 100 can include a cutting face 109. The cutting face 109 can be configured to drill or cut material as the drill bit 100 is rotated and advanced into a formation. As shown by FIGS. 1 and 2, in one or more implementations, the cutting face 109 can include a plurality of grooves 110 extending generally axially into the cutting face 109. The grooves 110 can help allow for a quick start-up of a new drill bit 100. In alternative implementations, the cutting face 109 may not include grooves 110 or may include other features for aiding in the drilling process.

The cutting face 109 can also include waterways that may allow drilling fluid or other lubricants to flow across the cutting face 109 to help provide cooling during drilling. For example, FIG. 1 illustrates that the crown 104 can include a plurality of notches 112 that extend from the cutting face 109 in a generally axial direction into the crown 104 of the drill bit 100. Additionally, the notches 112 can extend from the inner surface 107 of the crown 104 to the outer surface 108 of the crown 104. As waterways, the notches 112 can allow drilling fluid to flow from the inner surface 107 of the crown 104 to the outer surface 108 of the crown 104. Thus, the notches 112 can allow drilling fluid to flush cuttings and debris from the inner surface 107 to the outer surface 108 of the drill bit 100, and also provide cooling to the cutting face 109.

The crown 104 may have any number of notches that provides the desired amount of fluid/debris flow and also allows the crown 104 to maintain the structural integrity needed. For example, FIGS. 1 and 2 illustrate that the drill bit 100 includes nine notches 112. One will appreciate in light of the disclosure herein that the present invention is not so limited. In additional implementations, the drill bit 100 can include as few as one notch or as many 20 or more notches, depending on the desired configuration and the formation to be drilled. Additionally, the notches 112 may be evenly or unevenly spaced around the circumference of the crown 104. For example, FIG. 2 depicts nine notches 112 evenly spaced from each other about the circumference of the crown 104. In alternative implementations, however, the notches 112 can be staggered or otherwise not evenly spaced.

As shown in FIGS. 1 and 2, each notch 112 can be defined by at least three surfaces 112*a*, 112*b*, 112*c*. In particular, each notch 112 can be defined by a first side surface 112*a*, an opposing side surface 112*b*, and a top surface 112*c*. In some implementations of the present invention, each of the sides surfaces 112*a*, 112*b* can extend from the inner surface 107 of the crown 104 to the outer surface 108 of the crown 104 in a direction generally normal to the inner surface of the crown 104 as illustrated by FIG. 2. Thus, in some implementations of the present invention, the width 114 of each notch 112 at the outer surface 108 of the crown 104 can be approximately equal to the width 116 of each notch 112 at the inner surface 107 of the crown 104. In other words, the circumferential distance 114 between the first side surface 112*a* and the second side surface 112*b* of each notch 112 at the outer surface 108 can be approximately equal to the circumferential distance 116 between the first side surface 112*a* and the second side surface 112*b* of each notch 112 at the inner surface 107. In alternative implementations of the present invention, as explained in greater detail below, one or more of the side surfaces 112*a*, 112*b* may include a radial and/or a circumferential taper.

Thus, the notches 112 can have any shape that allows them to operate as intended. In particular, the shape and configuration of the notches 112 can be altered depending upon the characteristics desired for the drill bit 100 or the characteristics of the formation to be drilled. For example, the FIG. 2 illustrates that the notches can have a rectangular shape when viewed from cutting face 109. In alternative implementation, however, the notches can have square, triangular, circular, trapezoidal, polygonal, elliptical shape or any combination thereof.

Furthermore, the notches 112 may have any width or length that allows them to operate as intended. For example, FIG. 2 illustrates that the notches 112 can have a length (i.e., distance from the inside surface 107 to the outside surface 108) that is greater than their width (i.e., distance between opposing side surfaces 112*a* and 112*b*). In alternative implementations of the present invention, however, the notches 112 can have a width greater than their length, or a width that is approximately equal to their length.

Figure 3:
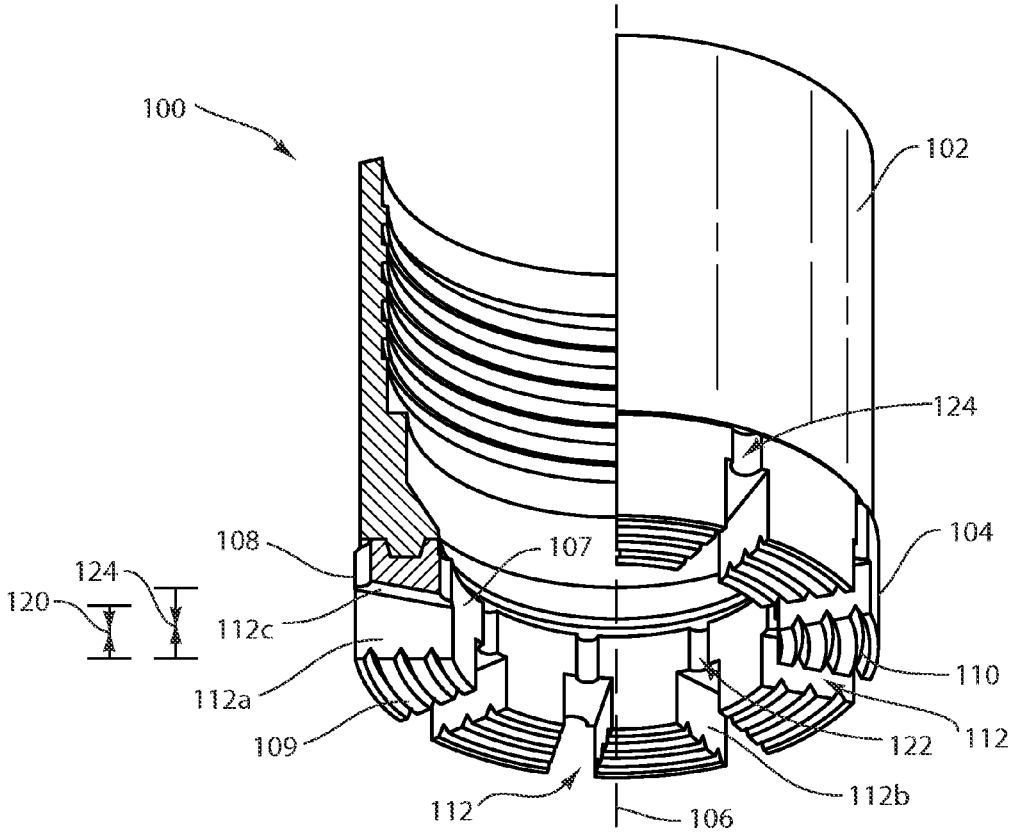
FIG. 3 illustrates a partial cross-sectional view of the drilling tool of FIG. 2 taken along the section line 3-3 of FIG. 2.

In addition, the individual notches 112 in the crown 104 can be configured uniformly with the same size and shape, or alternatively with different sizes and shapes. For example, FIGS. 1-3 illustrate all of the notches 112 in the crown 104 have the same size and configuration. In additional implementation, however, the various notches 112 of the crown 104 can include different sizes and configurations. For example, in some implementations the drill bit 100 can include two different sizes of notches 112 that alternate around the circumference of the crown 104.

As mentioned previously, the waterways (i.e., notches 112) can be axially tapered. In particular, as shown by FIG. 3, the top surface 112*c* of each notch 112 can taper from the inner surface 107 to the outer surface 108 in a direction generally from the cutting face 109 toward the shank 102. In other words, the height or longitudinal dimension of each notch 112 can increase as the notch 112 extends from the inner surface 107 to the outer surface 108 of the crown 104. Thus, as shown by FIG. 3, in some implementations the longitudinal dimension 124 of each notch 112 at the outer surface 108 can be greater than the longitudinal dimension 120 of each notch 112 at the inner surface 107. In other words, each notch 112 can extend into the cutting face 109 a first distance 120 at the inner surface 107 and extend into the cutting face 109 a second distance 124 at the outer surface 120, where the second distance 124 is greater than the first distance 120.

One will appreciate in light of the disclosure herein that the axial-taper of the notches 112 can help ensure that the opening of each notch 112 at the inner surface 107 is smaller than the opening of each notch 112 at the outer surface 108 of the crown 104. This difference in opening sizes can increase the velocity of drilling fluid at the inside surface 107 as it passes to the outside surface 108 of the crown 104. Thus, as explained above, the axial-taper of the notches 112 can provide for more efficient flushing of cuttings and cooling of the cutting face 109. Furthermore, the increasing size of the notches 112 can also help ensure that debris does not jam or clog in the notch 112 as drilling fluid forces it from the inner surface 107 to the outer surface 108.

Additionally, as shown by FIGS. 2 and 3, the axial-taper of the notches 112 can provide the notches 112 with increasing size without reducing the size of the cutting face 109. One will appreciate that in one or more implementations of the present invention, an increased surface area of the cutting face 109 can provide for more efficient drilling. Furthermore, the axial-taper of the notches 112 can provide for increased flushing and cooling, while also not decreasing the volume of crown material at the inside surface 107. The increased volume of crown material at the inside surface 107 can help increase the drilling life of the drill bit 100.

In addition to notches 112, the crown 104 can include additional features that can further aid in directing drilling fluid or other lubricants to the cutting face 109 or from the inside surface 107 to the outside surface 108 of the crown 104. For example, FIGS. 1-3 illustrate that the drill bit 110 can include a plurality of flutes 122, 124 extending radially into the crown 104. In particular, in some implementations of the present invention the drill bit 100 can include a plurality of inner flutes 122 that extend radially from the inner surface 107 toward the outer surface 108. The plurality of inner flutes 122 can help direct drilling fluid along the inner surface 107 of the drill bit 100 from the shank 102 toward the cutting face 109. As shown in FIG. 1-3, in some implementations of the present invention the inner flutes 122 can extend from the shank 102 axially along the inner surface 107 of the crown 104 to the notches 112. Thus, the inner flutes 122 can help direct drilling fluid to the notches 112. In alternative implementations, the inner flutes 122 can extend from the shank 102 to the cutting face 109, or even along the shank 102.

FIGS. 1-3 additionally illustrate that in some implementations, the drill bit 100 can include a plurality of outer flutes 124. The outer flutes 124 can extend radially from the outer surface 108 toward the inner surface 107 of the crown 104. The plurality of outer flutes 124 can help direct drilling fluid along the outer surface 108 of the drill bit 100 from the notches 112 toward the shank 102. As shown in FIGS. 1-3, in some implementations of the present invention the outer flutes 124 can extend from the notches 112 axially along the outer surface 108 to the shank 102. In alternative implementations, the outer flutes 124 can extend from the cutting face 109 to the shank 102, or even along the shank 102.

Figure 4:
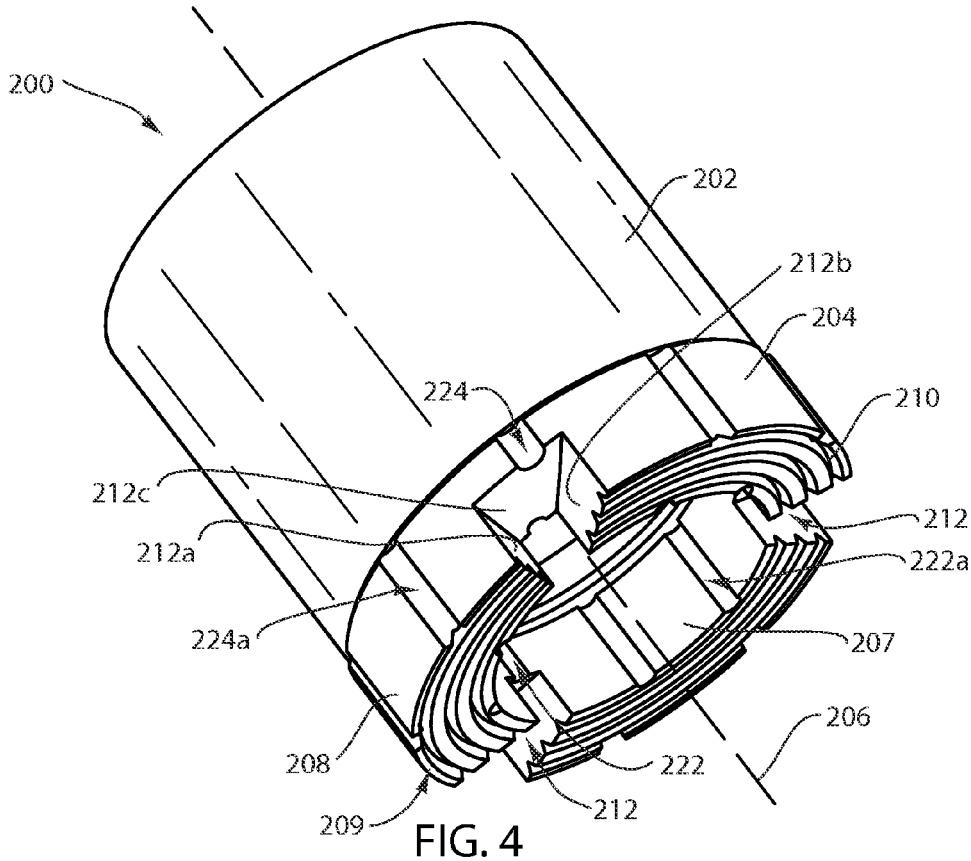
FIG. 4 illustrates a perspective view of a drilling tool including axially-tapered and radially-tapered waterways according to an implementation of the present invention.
Figure 5:
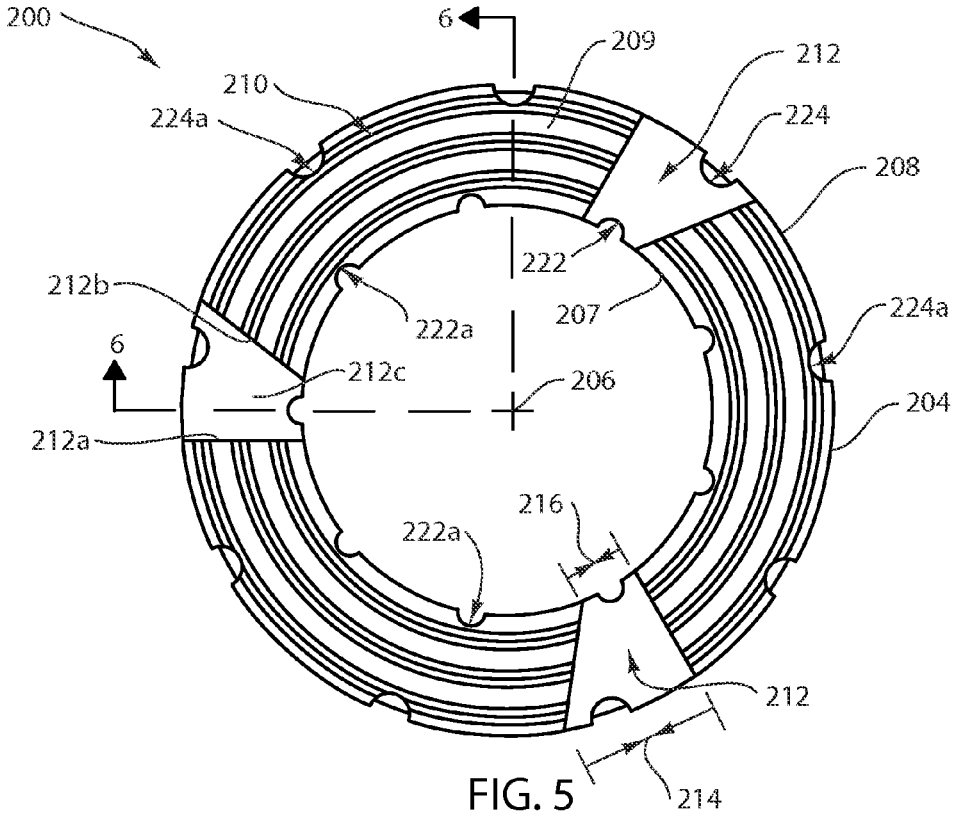
FIG. 5 illustrates a bottom view of the drilling tool of FIG. 4.
Figure 6:
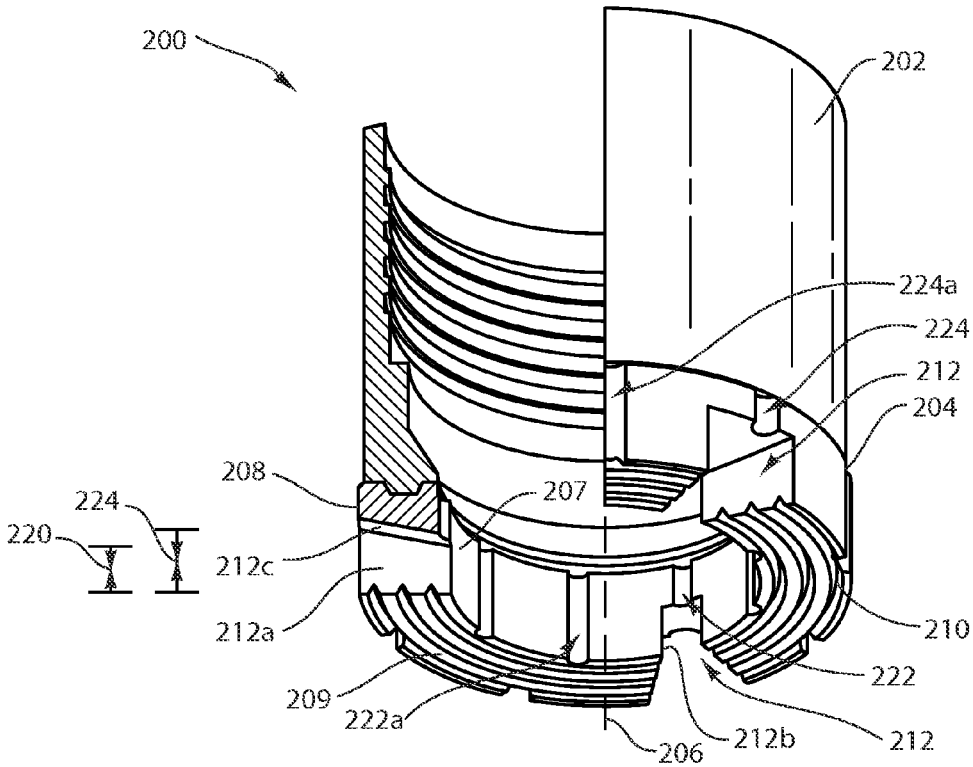
FIG. 6 illustrates a partial cross-sectional view of the drilling tool of FIG. 5 taken along the section line 6-6 of FIG. 5.

As mentioned previously, one or more implementations of the present invention can include double-tapered waterways. For example, FIGS. 4-6 illustrate various view of a drilling tool 200 including double-tapered waterways. In particular, FIG. 4 illustrates a perspective view, FIG. 5 illustrates a bottom view, and FIG. 6 illustrates a partial cross-sectional view of a core-sampling drill bit 200 having double-taped notches. Similar to the drill bit 100, the drill bit 200 can include a shank 202 and a crown 204.

The crown 204 can have a generally annular shape defined by an inner surface 207 and an outer surface 208. The crown 204 can additionally extend from the shank 202 and terminate in a cutting face 209. As shown by FIG. 4, in some implementations of the present invention, the cutting face 209 may extend from the inner surface 207 to the outer surface 208 in a direction generally normal to the longitudinal axis 206 of the drill bit 200. In some implementations, the cutting face 209 can include a plurality of grooves 210. The crown 204 can further include a plurality of double-tapered waterways 212 as explained in greater detail below.

As mentioned previously, the drill bit 200 can include double-tapered waterways. For example, FIG. 5 illustrates that each of the notches 212 can include a radial taper in addition to an axial taper. More specifically, each notch 212 can be defined by at least three surfaces 212*a*, 212*b*, 212*c*. In particular, each notch 212 can be defined by a first side surface 212*a*, an opposing side surface 212*b*, and a top surface 212*c*. In some implementations of the present invention, the first sides surface 212*a* can extend from the inner surface 207 of the crown 204 to the outer surface 208 of the crown 204 in a direction generally normal to the inner surface of the crown 204 as illustrated by FIG. 5.

As mentioned previously, the waterways (i.e., notches 212) can be radially tapered. In particular, as shown by FIG. 5, the second side surface 212*b* of each notch 212 can taper from the inner surface 207 to the outer surface 208 in a direction generally clockwise around the circumference of the cutting face 209. As used herein, the terms "clockwise" and "counterclockwise" refer to directions relative to the longitudinal axis of a drill bit when viewing the cutting face of the drill bit. Thus, the width of each notch 212 can increase as the notch 212 extends from the inner surface 207 to the outer surface 208 of the crown 204. Thus, as shown by FIG. 5, in some implementations the width 214 of each notch 212 at the outer surface 208 can be greater than the width 216 of each notch 212 at the inner surface 207. In other words, the circumferential distance 214 between the first side surface 212*a* and the second side surface 212*b* of each notch 212 at the outer surface 208 can be greater than the circumferential distance 216 between the first side surface 212*a* and the second side surface 212*b* of each notch 212 at the inner surface 207.

One will appreciate in light of the disclosure herein that the radial taper of the notches 212 can ensure that the opening of each notch 212 at the inner surface 207 is smaller than the opening of each notch 212 at the outer surface 208 of the crown 204. This difference in opening sizes can increase the velocity of drilling fluid at the inside surface 207 as it passes to the outside surface 208 of the crown 204. Thus, as explained above, the radial taper of the notches 212 can provide for more efficient flushing of cuttings and cooling of the cutting face 209. Furthermore, the increasing width of the notches 212 can also help ensure that debris does not jam or clog in the notch 212 as drilling fluid forces it from the inner surface 207 to the outer surface 208.

FIGS. 4-6 illustrate that the radial taper of the notches 212 can be formed by a tapered second side surface 212*b*. One will appreciate that alternatively the first side surface 212*a* can include a taper. For example, the first side surface 212*a* can taper from the inner surface 207 to the outer surface 208 in a direction generally counter-clockwise around the circumference of the cutting face 209. Additionally, in some implementation the first side surface 212*a* and the second side surface 212*b* can both include a taper extending from the inner surface 207 to the outer surface 208 in a direction generally clockwise around the circumference of the cutting face 209. In such implementations, the radial taper of the second side surface 212*b* can have a larger taper than the first side surface 212*a* in a manner that the width of the notch 212 increases as the notch 212 extends from the inner surface 207 to the outer surface 208.

As mentioned previously, the waterways (i.e., notches 212) can be axially tapered in addition to being radially tapered. In particular, as shown by FIG. 6, the top surface 212*c* of each notch 212 can taper from the inner surface 207 to the outer surface 208 in a direction generally from the cutting face 209 toward the shank 202. In other words, the longitudinal dimension of each notch 212 can increase as the notch 212 extends from the inner surface 207 to the outer surface 208 of the crown 204. Thus, as shown by FIG. 6, in some implementations the longitudinal dimension 224 of each notch 212 at the outer surface 208 can be greater than the longitudinal dimension 220 of each notch 212 at the inner surface 207. In other words, each notch 212 can extend into the cutting face 209 a first distance 220 at the inner surface 207 and extend into the cutting face 209 a second distance 224 at the outer surface 208, where the second distance 224 is greater than the first distance 220.

One will appreciate in light of the disclosure herein that the axial taper of the notches 212 can help ensure that the opening of each notch 212 at the inner surface 207 is smaller than the opening of each notch 212 at the outer surface 208 of the crown 204. This difference in opening sizes can increase the velocity of drilling fluid at the inside surface 207 as it passes to the outside surface 208 of the crown 204. Thus, as explained above, the axial-taper of the notches 212 can provide for more efficient flushing of cuttings and cooling of the cutting face 209. Furthermore, the increasing size of the notches 212 can also help ensure that debris does not jam or clog in the notch 212 as drilling fluid forces it from the inner surface 207 to the outer surface 208.

One will appreciate in light of the disclosure therein that the double-tapered notches 212 can ensure that the notches 212 increase in dimension in each axis (i.e., both radially and axially) as they extend from the inner surface 207 of the drill bit 200 to the outer surface 208. The increasing size of the double-tapered notches 212 can reduce the likelihood of debris lodging within the notches 212, and thus, increase the drilling performance of the drill bit 200. Furthermore, as previously discussed the increasing size of the double-tapered notches 212 can help maximize the volume of matrix material at the inner surface 107, and thereby can increase the life of the drill bit 200 by reducing premature drill bit wear at the inner surface 207.

In addition to the waterways, the crown 204 can include a plurality of flutes for directing drilling fluid, similar to the flutes described herein above in relation to the drill bit 100. For example, in some implementations of the present invention the drill bit 200 can include a plurality of inner flutes 222 that can extend radially from the inner surface 207 toward the outer surface 208. The plurality of inner flutes 222 can help direct drilling fluid along the inner surface 207 of the drill bit 200 from the shank 202 toward the cutting face 209. As shown in FIG. 4-6, in some implementations of the present invention the inner flutes 222 can extend from the shank 202 axially along the inner surface 207 to the notches 212. Thus, the inner flutes 222 can help direct drilling fluid to the notches 212.

Additionally, the crown 204 can include full inner flutes 222*a*. As shown in FIG. 4, the full inner flutes 222*a* can extend from the shank 202 to the cutting face 209 without intersecting a notch 212. Along similar lines, the drill bit 200 can include outer flutes 224 and full outer flutes 224*a*. The outer flutes 224 can extend from the shank 202 to a notch 212, while the full outer flutes 224*a* can extend from the shank 202 to the cutting face 209 without intersecting a notch 212. In alternative implementations, the full inner flutes 222*a* and/or the full outer flutes 224*a* can extend from the shank 202 to the cutting face 209 and also run along the a side surface 212*a*, 212*b* of a notch 212.

As mentioned previously, in one or more implementations of the present invention the waterways of the drilling tools can include a radial taper. For example, FIGS. 4-6 illustrate notches 212 having a second side surface 212*b* including a radial taper. Alternatively, both side surfaces can include a radial taper. For example, FIG. 7 illustrates a bottom view of a core-sampling drill bit 300 including double-tapered notches 312 where both of the side surfaces 312*a*, 312*b* include a radial taper.

Similar to the other drill bits described herein above, the drill bit 300 can include a shank 302 and a crown 304. The crown 304 can have a generally annular shape defined by an inner surface 307 and an outer surface 308. The crown 304 can thus define a space about a central axis 306 for receiving a core sample. The crown 304 can additionally extend from the shank 302 and terminate in a cutting face 309. The cutting face 309 can include a plurality of grooves 310 extending therein. Additionally, the drill bit 300 can include inner flutes 322 and outer flutes 324 for directing drilling fluid about the drill bit 300.

Figure 7:
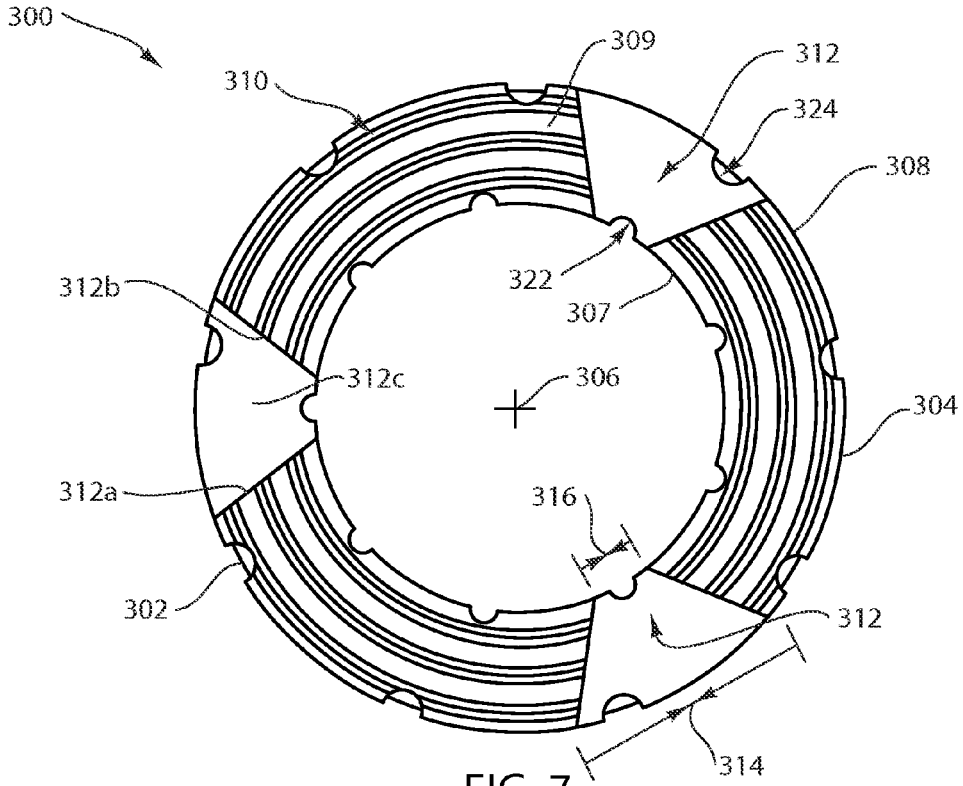
FIG. 7 illustrates a bottom view of a drilling tool including axially-tapered and double radially-tapered waterways according to another implementation of the present invention.

Furthermore, as shown by FIG. 7, the second side surface 312*b* of each notch 312 can taper from the inner surface 307 to the outer surface 308 of the crown 304 in a direction generally clockwise around the circumference of the cutting face 309. Additionally, the first side surface 312*a* of each notch 312 can taper from the inner surface 307 to the outer surface 308 of the crown 304 in a direction generally counter-clockwise around the circumference of the cutting face 309. Thus, the width of each notch 312 can increase as the notch 312 extends from the inner surface 307 to the outer surface 308 of the crown 304.

Thus, as shown by FIG. 7, in some implementations the width 314 of each notch 312 at the outer surface 308 can be greater than the width 316 of each notch 312 at the inner surface 307. In other words, the circumferential distance 314 between the first side surface 312*a* and the second side surface 312*b* of each notch 312 at the outer surface 308 can be greater than the circumferential distance 316 between the first side surface 312*a* and the second side surface 312*b* of each notch 312 at the inner surface 307.

Each of the axially-tapered waterways described herein above have been notches extending into a cutting face of a crown. One will appreciate in light of the disclosure herein that the present invention can include various other or additional waterways having an axial taper. For instance, the drilling tools of one or more implementations of the present invention can include one or more enclosed fluid slots having an axial taper, such as the enclosed fluid slots described in U.S. patent application Ser. No. 11/610,680, filed Dec. 14, 2006, entitled "Core Drill Bit with Extended Crown Longitudinal dimension," the content of which is hereby incorporated herein by reference in its entirety.

Figure 8:
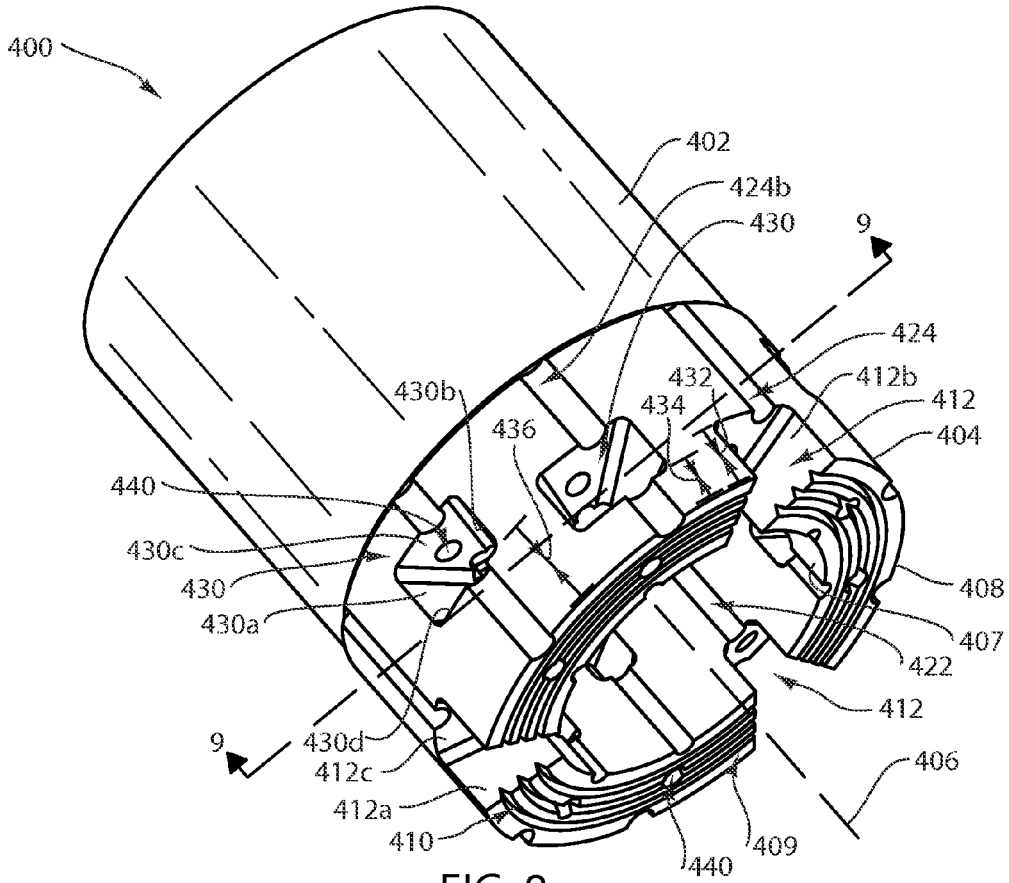
FIG. 8 illustrates a perspective view of a drilling tool including axially-tapered notches and axially-tapered enclosed slots according to an implementation of the present invention.
Figure 9:
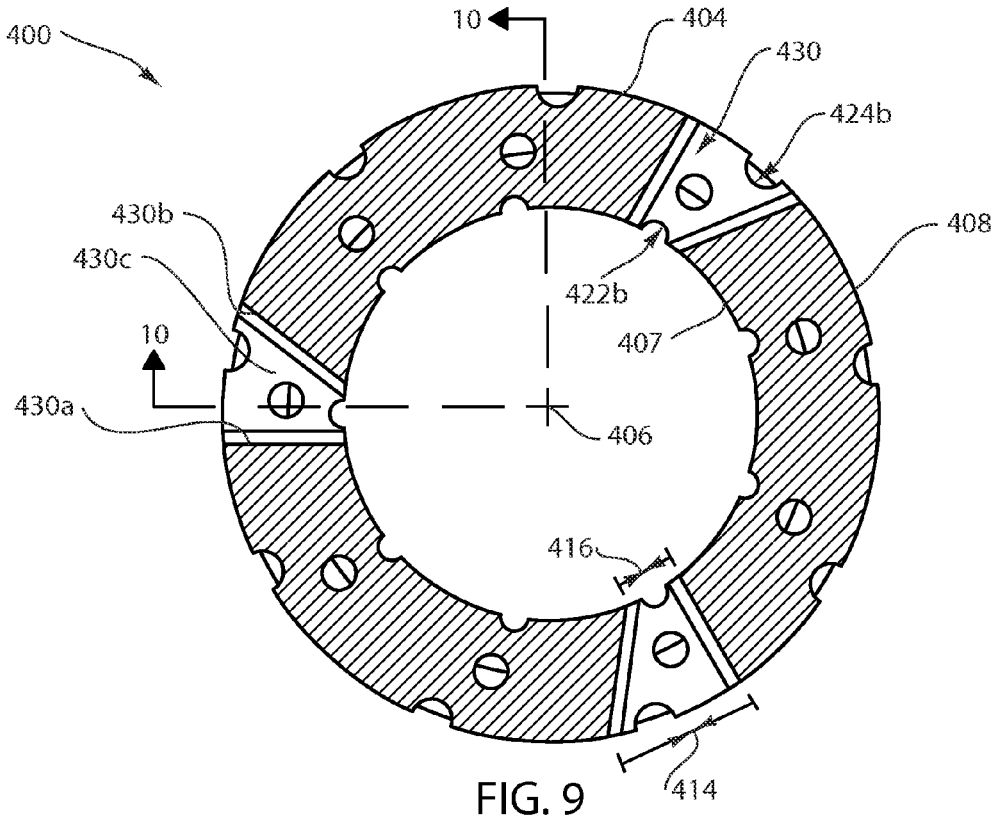
FIG. 9 illustrates a cross-sectional view of the drilling tool of FIG. 8 taken along the section line 9-9 of FIG. 8.
Figure 10:
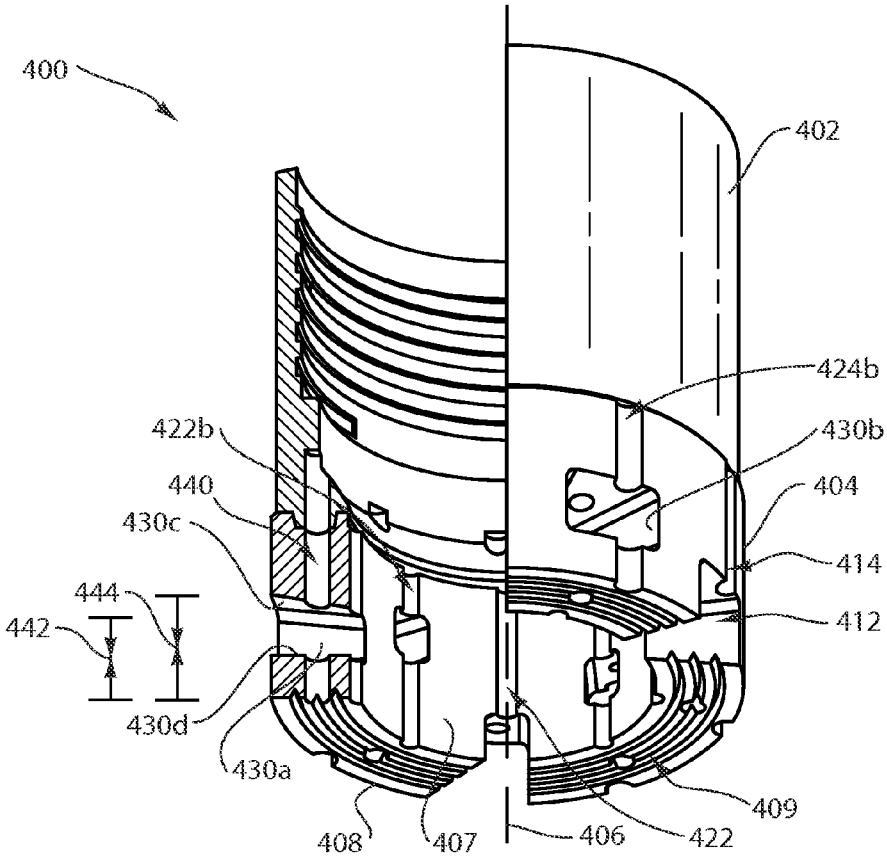
FIG. 10 illustrates a partial cross-sectional view of the drilling tool of FIG. 9 taken along the section line 10-10 of FIG. 9.

For example, FIGS. 8-10 illustrate various views of a core-sampling drill bit 400 that includes both axially-taper notches and axially-tapered enclosed slots. Similar to the other drill bits described herein above, the drill bit 400 can include a shank 402 and a crown 404. The crown 404 can have a generally annular shape defined by an inner surface 407 and an outer surface 408. The crown 404 can additionally extend from the shank 402 and terminate in a cutting face 409. In some implementations, the cutting face 409 can include a plurality of grooves 410 extending therein as shown in FIGS. 8-10.

As shown in FIG. 8 the drill bit 400 can include double-tapered notches 412 similar in configuration to double-taped notches 212 described above in relation to FIGS. 4-6. Thus, notches 412 can a top surface 412*c* that can taper from the inner surface 407 to the outer surface 408 in a direction generally from the cutting face 409 toward the shank 402. Additionally, a first side surface 412*a* of each notch 412 can extend from the inner surface 407 of the crown 404 to the outer surface 408 of the crown 404 in a direction generally normal to the inner surface of the crown 404. Furthermore, a second side surface 412*b* of each notch 412 can taper from the inner surface 407 to the outer surface 408 in a direction generally clockwise around the circumference of the cutting face 409.

In addition to the double-tapered notches 412, the drill bit can include a plurality of enclosed slots 430. The enclosed slots 430 can include an axial and/or a radial taper as explained in greater detail below. One will appreciate that as the crown 404 erodes through drilling, the notches 412 can wear away. As the erosion progresses, the enclosed slots 430 can become exposed at the cutting face 409 and then thus become notches. One will appreciate that the configuration of drill bit 400 can thus allow the longitudinal dimension of the crown 404 to be extended and lengthened without substantially reducing the structural integrity of the drill bit 400. The extended longitudinal dimension of the crown 404 can in turn allow the drill bit 400 to last longer and require less tripping in and out of the borehole to replace the drill bit 400.

In particular, FIG. 8 illustrates that the crown 404 can include a plurality of enclosed slots 430 that extend a distance from the cutting face 409 toward the shank 402 of the drill bit 400. Additionally, the enclosed slots 430 can extend from the inner surface 407 of the crown 404 to the outer surface 408 of the crown 404. As waterways, the enclosed slots 430 can allow drilling fluid to flow from the inner surface 407 of the crown 404 to the outer surface 408 of the crown 404. Thus, the enclosed slots 430 can allow drilling fluid to flush cuttings and debris from the inner surface 407 to the outer surface 408 of the drill bit 400, and also provide cooling to the cutting face 409.

The crown 404 may have any number of enclosed slots 430 that provides the desired amount of fluid/debris flow or crown longitudinal dimension, while also allowing the crown 404 to maintain the structural integrity needed. For example, FIGS. 8 and 10 illustrate that the drill bit 400 can include six enclosed slots 430. One will appreciate in light of the disclosure herein that the present invention is not so limited. In additional implementations, the drill bit 400 can include as few as one enclosed slot or as many 20 or more enclosed slots, depending on the desired configuration and the formation to be drilled. Additionally, the enclosed slots 430 may be evenly or unevenly spaced around the circumference of the crown 404. For example, FIGS. 8-10 depict enclosed slots 430 evenly spaced from each other about the circumference of the crown 404. In alternative implementations, however, the enclosed slots 430 can be staggered or otherwise not evenly spaced.

As shown in FIG. 8, each enclosed slot 430 can be defined by four surfaces 430*a*, 430*b*, 430*c*, 430*d*. In particular, each enclosed slot 430 can be defined by a first side surface 430*a*, an opposing side surface 430*b*, a top surface 430*c*, and an opposing bottom surface 430*d*. In some implementations of the present invention, each of the sides surfaces 430*a*, 430*b* can extend from the inner surface 407 of the crown 404 to the outer surface 408 of the crown 404 in a direction generally normal to the inner surface of the crown 404. In alternative implementations of the present invention, as explained in greater detail below, one or more of the side surfaces 430*a*, 430*b* may include a radial and/or a circumferential taper.

Thus, the enclosed slots 430 can have any shape that allows them to operate as intended, and the shape can be altered depending upon the characteristics desired for the drill bit 400 or the characteristics of the formation to be drilled. For example, the FIG. 9 illustrates that the enclosed slots can have a trapezoidal shape. In alternative implementation, however, the enclosed slots 430 can have square, triangular, circular, rectangular, polygonal, or elliptical shapes, or any combination thereof.

Furthermore, the enclosed slots 430 may have any width or length that allows them to operate as intended. For example, FIG. 9 illustrates that the enclosed slots 430 have a length (i.e., distance from the inside surface 407 to the outside surface 408) that is greater than their width (i.e., distance between opposing side surfaces 430*a* and 430*b*). In addition, the individual enclosed slots 430 in the crown 404 can be configured uniformly with the same size and shape, or alternatively with different sizes and shapes. For example, FIGS. 8-10 illustrate all of the enclosed slots 430 in the crown 404 can have the same size and configuration. In additional implementation, however, the various enclosed slots 430 of the crown 404 can include different sizes and configurations.

Furthermore, the crown 404 can include various rows of waterways. For example, FIG. 8 illustrates that the crown 404 can include a row of notches 412 that extend a first distance 432 from the cutting face 409 into the crown 404. Additionally, FIG. 8 illustrates that the crown 404 can include a first row of enclosed slots 430 commencing in the crown 404 a second distance 434 from the cutting face 409, and a second row of enclosed slots 430 commencing in the crown 404 a third distance 436 from the cutting face 409. In alternative implementations of the present invention, the crown 404 can include a single row of enclosed slots 430 or multiple rows of enclosed slots 430 each axially staggered from the other.

In some instances, a portion of the notches 412 can axially overlap the first row of enclosed slots 430. In other words, the first distance 432 can be greater than the second distance 434. Along similar lines, a portion of the enclosed slots 430 in the first row can axially overlap the enclosed slots in the second row. One will appreciate in light of the disclosure herein that the axially overlap of the waterways 412, 430 can help ensure that before notches 412 have completely eroded away during drilling, the first row of enclosed slots 430 will open to become notches 412, allowing the drill bit 400 to continue to cut efficiently as the drill bit 400 erodes.

Additionally, as FIG. 8 illustrates, the enclosed slots 430 in the first row can be circumferentially offset from the notches 412. Similarly, the enclosed slots 430 in the second row can be circumferentially offset from the enclosed slots 430 in the first row and the notches 412. In alternative implementations, one or more of the enclosed slots 430 in the first and second row can be circumferentially aligned with each other or the notches 412.

As mentioned previously, in one or more implementations the enclosed slots 430 can include a double-taper. For example, FIG. 9 illustrates that each of the enclosed slots 430 can include a radial taper. In some implementations of the present invention, the first side surface 430*a* can extend from the inner surface 407 of the crown 404 to the outer surface 408 of the crown 404 in a direction generally normal to the inner surface 407 of the crown 404 as illustrated by FIG. 9.

Furthermore, the second side surface 430*b* of each enclosed slot 430 can taper from the inner surface 407 to the outer surface 408 in a direction generally clockwise around the circumference of the crown 404. In other words, the width of each enclosed slot 430 can increase as the enclosed slot 430 extends from the inner surface 407 to the outer surface 408 of the crown 404. Thus, as shown by FIG. 9, in some implementations the width 414 of each enclosed slot 430 at the outer surface 408 can be greater than the width 416 of each enclosed slot 430 at the inner surface 407. In other words, the circumferential distance 414 between the first side surface 430*a* and the second side surface 430*b* of each enclosed slot 430 at the outer surface 408 can be greater than the circumferential distance 416 between the first side surface 430*a* and the second side surface 430*b* of each enclosed slot 430 at the inner surface 407.

One will appreciate in light of the disclosure herein that the radial taper of the enclosed slots 430 can ensure that the opening of each enclosed slot 430 at the inner surface 407 is smaller than the opening of each enclosed slot 430 at the outer surface 408 of the crown 404. This difference in opening sizes can increase the velocity of drilling fluid at the inside surface 407 as it passes to the outside surface 408 of the crown 404. Thus, as explained above, the radial-taper of the enclosed slots 430 can provide for more efficient flushing of cuttings and cooling of the drill bit 400. Furthermore, the increasing width of the enclosed slots 430 can also help ensure that debris does not jam or clog in the enclosed slot 430 as drilling fluid forces it from the inner surface 407 to the outer surface 408.

FIGS. 8-10 also illustrate that the radial taper of the enclosed slots 430 can be formed by a tapered second side surface 430*b*. One will appreciate that in alternatively, or additionally, the first side surface 430*a* can include a taper. For example, the first side surface 430*a* can taper from the inner surface 407 to the outer surface 408 in a direction generally counter-clockwise around the circumference of the crown 404.

As mentioned previously, the waterways (i.e., enclosed slots 430) can be axially tapered in addition to being radially tapered. In particular, as shown by FIG. 10, the top surface 430*c* of each enclosed slot 430 can taper from the inner surface 407 to the outer surface 408 in a direction generally from the cutting face 409 toward the shank 402. In other words, the longitudinal dimension of each enclosed slot 430 can increase as the enclosed slot 430 extends from the inner surface 407 to the outer surface 408 of the crown 404. Thus, as shown by FIG. 10, in some implementations the longitudinal dimension 444 of each enclosed slot 430 at the outer surface 408 can be greater than the longitudinal dimension 442 of each enclosed slot 430 at the inner surface 407. Or in other words, the top surface 430*c* of each enclosed slot 430 at the outer surface 408 can be farther from the cutting face 409 than the top surface 430*c* of each enclosed slot 430 at the inner surface 407.

Alternatively, or additionally, the bottom surface 430*d* of each enclosed slot 430 can taper from the inner surface 407 to the outer surface 408 in a direction generally from the shank 402 toward the cutting face 409. In other words, the longitudinal dimension of each enclosed slot 430 can increase as the enclosed slot 430 extends from the inner surface 407 to the outer surface 408 of the crown 404. Or in other words, the bottom surface 430*d* of each enclosed slot 430 at the outer surface 408 can be closer to the cutting face 409 than the bottom surface 430*d* of each enclosed slot 430 at the inner surface 407. Thus, in some implementations the enclosed slots 430 can include a double-axial taper where both the top surface 430*c* and the bottom surface 430*d* include a taper.

One will appreciate in light of the disclosure herein that the axial-taper of the enclosed slots 430 can ensure that the opening of each enclosed slot 430 at the inner surface 407 is smaller than the opening of each enclosed slot 430 at the outer surface 408 of the crown 404. This difference in opening sizes can increase the velocity of drilling fluid at the inside surface 407 as it passes to the outside surface 408 of the crown. Thus, as explained above, the axial-taper of the enclosed slots 430 can provide for more efficient flushing of cuttings and cooling of the drill bit 404. Furthermore, the increasing size of the enclosed slots 430 can also help ensure that debris does not jam or clog in the enclosed slots 430 as drilling fluid forces it from the inner surface 407 to the outer surface 408.

One will appreciate in light of the disclosure therein that the double-tapered enclosed slots 430 can ensure that the enclosed slots 430 increase in dimension in each axis as they extend from the inner surface 407 of the drill bit 400 to the outer surface 408. The increasing size of the double-tapered enclosed slots 430 can reduce the likelihood of debris lodging within the enclosed slots 430, and thus, increase the drilling performance of the drill bit 400. Furthermore, the double-tapered enclosed slots 430 can provide efficient flushing while also reducing the removal of material at the inner surface 407 of the drill bit 400. Thus, the double-tapered enclosed slots 430 can help increase the drilling life of the drill bit by helping to reduce premature wear of the drill bit 400 near the inner surface 407.

FIGS. 8-10 further illustrate that the corners of the waterways 412, 430 can include a rounded surface or chamfer. The rounded surface of the corners of the waterways 412, 430 can help reduce the concentration of stresses, and thus can help increase the strength of the drill bit 400.

In addition to the waterways, the crown 404 can include a plurality of flutes for directing drilling fluid, similar to the flutes described herein above in relation to the drill bit 200. For example, in some implementations of the present invention the drill bit 400 can include a plurality of inner flutes 422 that extend radially from the inner surface 407 toward the outer surface 408. The plurality of inner flutes 422 can help direct drilling fluid along the inner surface 407 of the drill bit 400 from the shank 402 toward the cutting face 409. As shown in FIG. 8-10, in some implementations of the present invention the inner flutes 422 can extend from the shank 402 axially along the inner surface 407 to the notches 412. Thus, the inner flutes 422 can help direct drilling fluid to the notches 412.

Additionally, the crown 404 can include full inner flutes 422*b* that intersect an enclosed slot 430. As shown in FIG. 10, the full inner flutes 422*b* can extend from the shank 402 to the cutting face 409. In some implementations of the present invention, the full inner flutes 422*b* can intersect one or more enclosed slots 430 as illustrated by FIG. 10. Along similar lines, the drill bit 400 can include outer flutes 424 and full outer flutes 424*a*. The outer flutes 424 can extend from the shank 402 to a notch 412, while the full outer flutes 424*a* can extend from the shank 402 to the cutting face 409 while also intersecting an enclosed slot 430.

In addition to the waterways 412, 430 and flutes 422, 424, the drill bit 400 can further includes enclosed fluid channels 440. The enclosed fluid channels 440 can be enclosed within the drill bit 400 between the inner surface 407 and the outer surface 408. Furthermore, as shown in FIG. 10, the enclosed fluid channels 440 can extend from the shank 402 to a waterway 412, 430, or to the cutting face 409. The enclosed fluid channels 440 can thus direct drilling fluid to the cutting face 409 without having to flow across the inner surface 407 of the crown 404. One will appreciate in light of the disclosure herein that when drilling in sandy, broken, or fragmented formations, the enclosed fluid channels 440 can help ensure that a core sample is not flushed out of the drill bit 400 by the drilling fluid.

Some implementations of the present invention can include additional or alternative features to the enclosed fluid channels 440 that can help prevent washing away of a core sample. For example, in some implementations the drill bit 400 can include a thin wall along the inner surface 407 of the crown 404. The thin wall can close off the waterways 412, 430 so they do not extend radially to the interior of the crown 404. The thin wall can help reduce any fluid flowing to the interior of the crown 404, and thus, help prevent a sandy or fragmented core sample from washing away. Furthermore, the drill bit 400 may not include inner flutes 422. One will appreciate in light of the disclosure herein that in such implementations, drilling fluid can flow into the enclosed fluid channels 440, axially within the crown 404 to a waterway 412, 430, and then out of the waterway 412, 430 to the cutting face 409 or outer surface 408.

As mentioned previously, the shanks 102, 202, 302, 402 of the various drilling tools of the present invention can be configured to secure the drill bit to a drill string component. For example, the shank 102, 202, 302, 402 can include an American Petroleum Institute (API) threaded connection portion or other features to aid in attachment to a drill string component. By way of example and not limitation, the shank portion 102, 202, 302, 402 may be formed from steel, another iron-based alloy, or any other material that exhibits acceptable physical properties.

In some implementations of the present invention, the crown 104, 204, 304, 404 of the drill tools of the present invention can be made of one or more layers. For example, according to some implementations of the present invention, the crown 104, 204, 304, 404 can include two layers. In particular, the crown 104, 204, 304, 404 can include a matrix layer, which performs the drilling operation, and a backing layer, which connects the matrix layer to the shank 102, 202, 302, 402. In these implementations, the matrix layer can contain the abrasive cutting media that abrades and erodes the material being drilled.

In some implementations, the crown 104, 204, 304, 404 can be formed from a matrix of hard particulate material, such as for example, a metal. One will appreciate in light of the disclosure herein, that the hard particular material may include a powered material, such as for example, a powered metal or alloy, as well as ceramic compounds. According to some implementations of the present invention the hard particulate material can include tungsten carbide. As used herein, the term "tungsten carbide" means any material composition that contains chemical compounds of tungsten and carbon, such as, for example, WC, W2C, and combinations of WC and W2C. Thus, tungsten carbide includes, for example, cast tungsten carbide, sintered tungsten carbide, and macrocrystalline tungsten. According to additional or alternative implementations of the present invention, the hard particulate material can include carbide, tungsten, iron, cobalt, and/or molybdenum and carbides, borides, alloys thereof, or any other suitable material.

As mentioned previously, the crown 104, 204, 304, 404 can also include a plurality of abrasive cutting media dispersed throughout the hard particulate material. The abrasive cutting media can include one or more of natural diamonds, synthetic diamonds, polycrystalline diamond or thermally stable diamond products, aluminum oxide, silicon carbide, silicon nitride, tungsten carbide, cubic boron nitride, alumina, seeded or unseeded sol-gel alumina, or other suitable materials.

The abrasive cutting media used in the drilling tools of one or more implementations of the present invention can have any desired characteristic or combination of characteristics. For instance, the abrasive cutting media can be of any size, shape, grain, quality, grit, concentration, etc. In some embodiments, the abrasive cutting media can be very small and substantially round in order to leave a smooth finish on the material being cut by the core-sampling drill bit 100, 200, 300, 400. In other embodiments, the cutting media can be larger to cut aggressively into the material or formation being drill.

The abrasive cutting media can be dispersed homogeneously or heterogeneously throughout the crown 104, 204, 304, 404. As well, the abrasive cutting media can be aligned in a particular manner so that the drilling properties of the media are presented in an advantageous position with respect to the crown 104, 204, 304, 404. Similarly, the abrasive cutting media can be contained in the crown 104, 204, 304, 404 in a variety of densities as desired for a particular use. For example, large abrasive cutting media spaced further apart can cut material more quickly than small abrasive cutting media packed tightly together. Thus, one will appreciate in light of the disclosure herein that the size, density, and shape of the abrasive cutting media can be provided in a variety of combinations depending on desired cost and performance of the drill bit 100, 200, 300, 400.

For example, the crown 104, 204, 304, 404 may be manufactured to any desired specification or given any desired characteristic(s). In this way, the crown 104, 204, 304, 404 may be custom-engineered to possess optimal characteristics for drilling specific materials. For example, a hard, abrasion resistant matrix may be made to drill soft, abrasive, unconsolidated formations, while a soft ductile matrix may be made to drill an extremely hard, non-abrasive, consolidated formation. In this way, the matrix hardness may be matched to particular formations, allowing the matrix layer to erode at a controlled, desired rate.

One will appreciate that the drilling tools with a tailored cutting portion according to implementations of the present invention can be used with almost any type of drilling system to perform various drilling operations. For example, FIG. 11, and the corresponding text, illustrate or describe one such drilling system with which drilling tools of the present invention can be used. One will appreciate, however, the drilling system shown and described in FIG. 11 is only one example of a system with which drilling tools of the present invention can be used.

Figure 11:
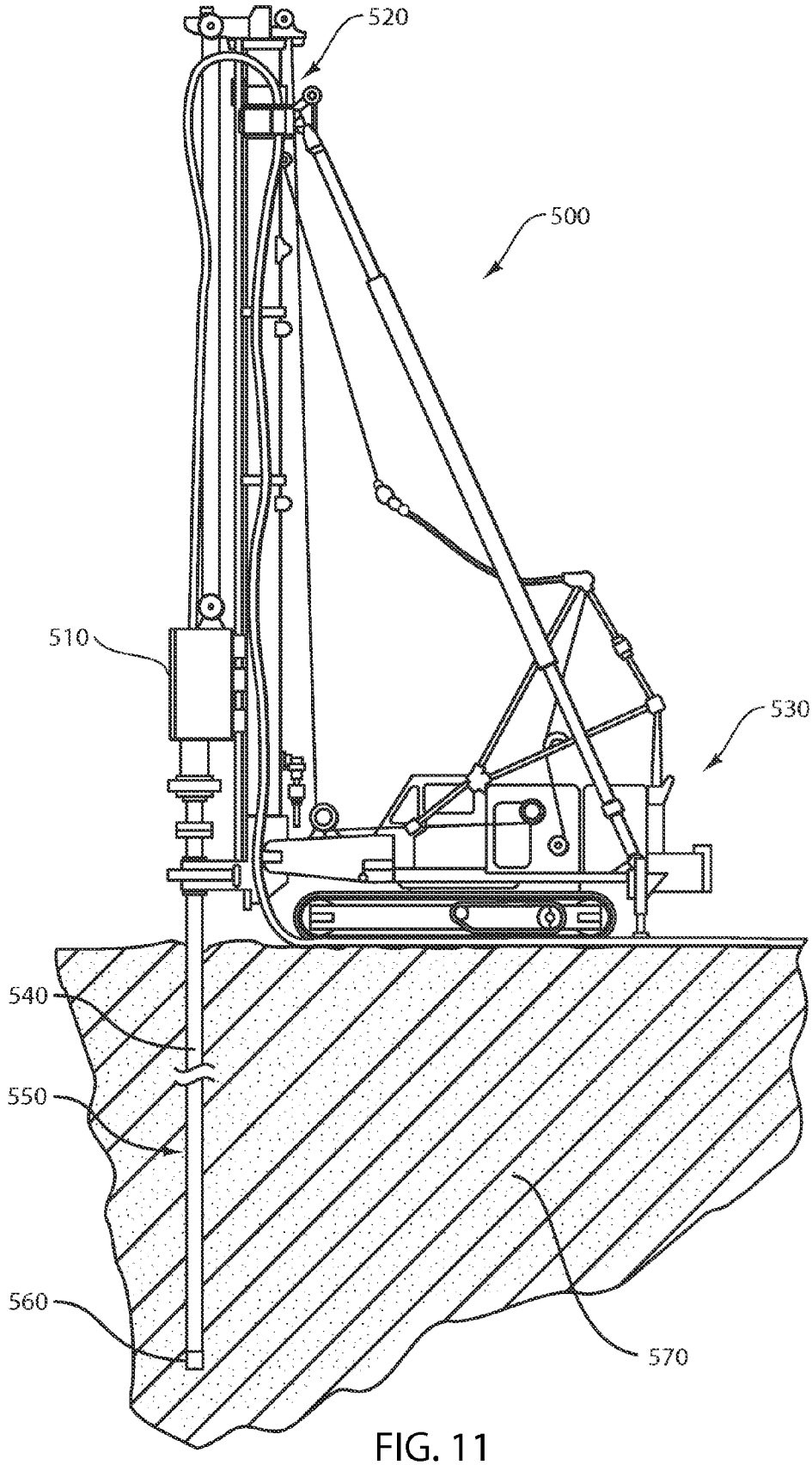
FIG. 11 illustrates a schematic view a drilling system including a drilling tool having axially-tapered waterways in accordance with an implementation of the present invention.

For example, FIG. 11 illustrates a drilling system 500 that includes a drill head 510. The drill head 510 can be coupled to a mast 520 that in turn is coupled to a drill rig 530. The drill head 510 can be configured to have one or more tubular members 540 coupled thereto. Tubular members can include, without limitation, drill rods, casings, and down-the-hole hammers. For ease of reference, the tubular members 540 will be described herein after as drill string components. The drill string component 540 can in turn be coupled to additional drill string components 540 to form a drill or tool string 550. In turn, the drill string 550 can be coupled to drilling tool 560 including axially-tapered waterways, such as the core-sampling drill bits 100, 200, 300, 400 described hereinabove. As alluded to previously, the drilling tool 560 can be configured to interface with the material 570, or formation, to be drilled.

In at least one example, the drill head 510 illustrated in FIG. 11 can be configured rotate the drill string 550 during a drilling process. In particular, the drill head 510 can vary the speed at which the drill head 510 rotates. For instance, the rotational rate of the drill head and/or the torque the drill head 510 transmits to the drill string 550 can be selected as desired according to the drilling process.

Furthermore, the drilling system 500 can be configured to apply a generally longitudinal downward force to the drill string 550 to urge the drilling tool 560 into the formation 570 during a drilling operation. For example, the drilling system 500 can include a chain-drive assembly that is configured to move a sled assembly relative to the mast 520 to apply the generally longitudinal force to the drilling tool bit 560 as described above.

As used herein the term "longitudinal" means along the length of the drill string 550. Additionally, as used herein the terms "upper," "top," and "above" and "lower" and "below" refer to longitudinal positions on the drill string 550. The terms "upper," "top," and "above" refer to positions nearer the drill head 510 and "lower" and "below" refer to positions nearer the drilling tool 560.

Thus, one will appreciate in light of the disclosure herein, that the drilling tools of the present invention can be used for any purpose known in the art. For example, a diamond-impregnated core sampling drill bit 100, 200, 300, 400 can be attached to the end of the drill string 550, which is in turn connected to a drilling machine or rig 530. As the drill string 550 and therefore the drill bit 560 are rotated and pushed by the drilling machine 530, the drill bit 560 can grind away the materials in the subterranean formations 570 that are being drilled. The core samples that are drilled away can be withdrawn from the drill string 550. The cutting portion of the drill bit 560 can erode over time because of the grinding action. This process can continue until the cutting portion of a drill bit 560 has been consumed and the drilling string 550 can then be tripped out of the borehole and the drill bit 560 replaced.

Implementations of the present invention also include methods of forming drilling tools having axially-tapered waterways. The following describes at least one method of forming drilling tools having axially-tapered waterways. Of course, as a preliminary matter, one of ordinary skill in the art will recognize that the methods explained in detail can be modified to install a wide variety of configurations using one or more components of the present invention.

As an initial matter, the term "infiltration" or "infiltrating" as used herein involves melting a binder material and causing the molten binder to penetrate into and fill the spaces or pores of a matrix. Upon cooling, the binder can solidify, binding the particles of the matrix together. The term "sintering" as used herein means the removal of at least a portion of the pores between the particles (which can be accompanied by shrinkage) combined with coalescence and bonding between adjacent particles.

Figure 12:
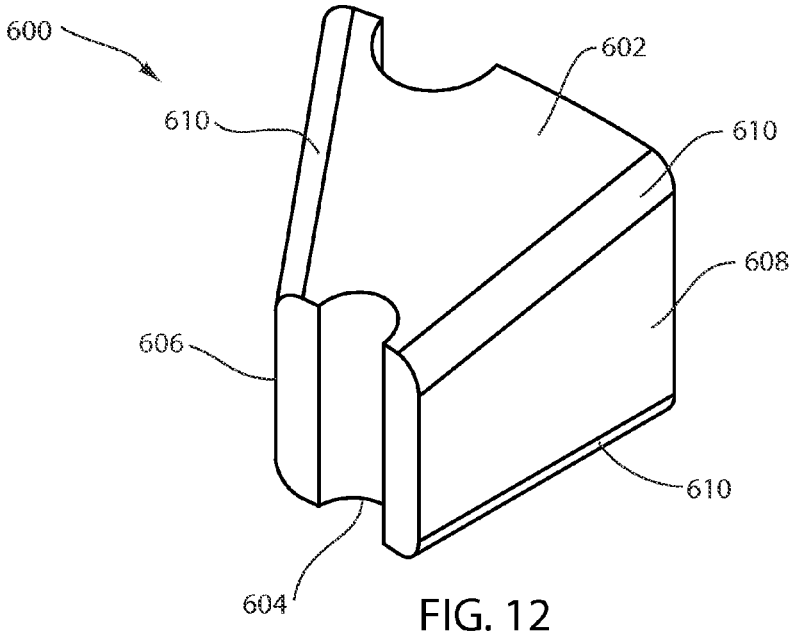
FIG. 12 illustrates a perspective view of plug for use in forming drilling tools having axially-tapered waterways in accordance with an implementation of the present invention.
Figure 13:
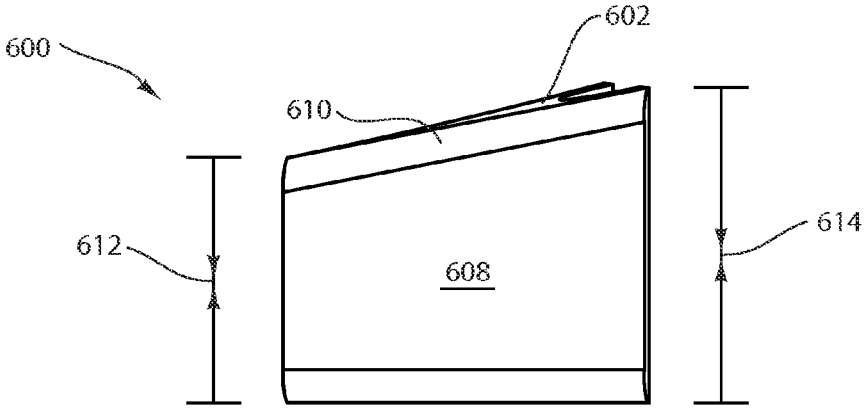
FIG. 13 illustrates a side view of the plug of FIG. 11.
Figure 14:
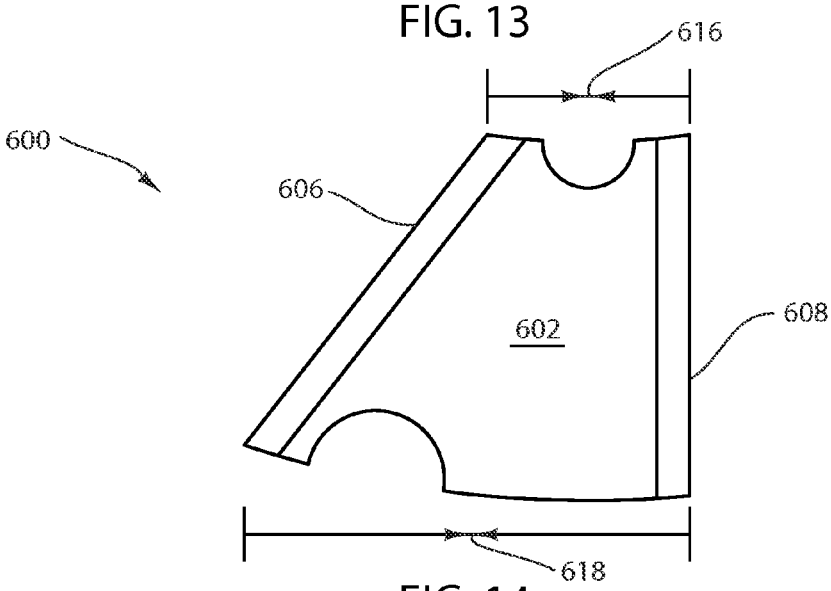
FIG. 14 illustrates a top view of the plug of FIG. 11.

One or more of the methods of the present invention can include using plugs to form the axially-tapered waterways in a drilling tool. For example, FIGS. 12-14 illustrate various views of a plug 600 that can be used to form an axially-tapered waterway, such as the notches 212 of drill bit 200 or slots 430 of drill bit 400. As shown by FIGS. 12-14, the plug 600 can include surfaces corresponding to the surfaces of an axially-tapered waterway. For example, the plug 600 can include a top surface 602, a bottom surface 604, a first side surface 608, and a second side surface 606. Additionally, the plug 600 can include chamfers 610 connecting the surfaces 602, 604, 606, 608 of the plug 600.

As shown by FIG. 13, the top surface 602 of the plug 600 can include a taper such that a first end of the plug 600 can have a first longitudinal dimension 612 and a second end of the plug 600 can have a second longitudinal dimension 614 that is greater than the first longitudinal dimension 612. Thus, as explained in greater detail below the taper of the top surface 602 can help form the axial taper of a waterway.

Along similar lines, FIG. 14 illustrates that the second side surface 606 can include a taper such that the first end of the plug 600 can have a first width 616 and the second end of the plug 600 can have a second width 618 that is greater than the first width 616. Thus, as explained in greater detail below the taper of the second side surface 606 can help form the radial taper of a waterway. One will appreciate that the shape and configuration of the plug 600 can vary depending upon the desired shape and configuration of a waterway to be formed with the plug 600.

In some implementations of the present invention the plug 600 can be formed from graphite, carbon, or other material with suitable material characteristics. For example, the plug 600 can be formed from a material which will not significantly melt or decay during infiltration or sintering. As explained in greater detail below, by using a plug 600 formed from a material that does not significantly melt, the plug 600 can be relatively easily removed from an infiltrated drilling tool.

One method of the present invention can include providing a matrix of hard particulate material and abrasive cutting media, such as the previously described hard particulate materials and abrasive cutting media materials. In some implementations of the present invention, the hard particulate material can comprise a power mixture. The method can also involve pressing or otherwise shaping the matrix into a desired form. For example, the method can involve forming the matrix into the shape of an annular crown. The method can then involve placing a plurality of plugs into the matrix. For example, the method can involve placing the bottom surface 602 into a surface of the annular crown that corresponds to a cutting face in order to form a notch 112, 212, 312, 412. Additionally, or alternatively, the method can involve placing a plug 600 into the body of the annular crown a distance from the surface of the annular crown that corresponds to a cutting face to form an enclosed slot 430.

The method can then infiltrating the matrix with a binder. The binder can comprise copper, zinc, silver, molybdenum, nickel, cobalt, or mixture and alloys thereof. The binder can cool thereby bonding to the matrix (hard particulate material and abrasive cutting media), thereby binding the matrix together. The binder may not significantly bond to the plug 600, thereby allowing removal of the plug 600 to expose an axially or double tapered waterway.

Another, method of the present invention generally includes providing a matrix and filling a mold having plugs 600 placed therein with the matrix. The mold can be formed from a material to which a binder material may not significantly bond to, such as for example, graphite or carbon. The method can then involve densification of the matrix by gravity and/or vibration. The method can then involve infiltrating matrix with a binder comprising one or more of the materials previously mentioned. The binder can cool thereby bonding to the matrix (hard particulate material and abrasive cutting media), thereby binding the matrix together. The binder may not significantly bond to the plug 600 or the mold, thereby allowing removal of the plug 600 to expose an axially or double tapered waterway.

Before, after, or in tandem with the infiltration of the matrix, one or more methods of the present invention can include sintering the matrix to a desired density. As sintering involves densification and removal of porosity within a structure, the structure being sintered can shrink during the sintering process. A structure can experience linear shrinkage of between 1% and 40% during sintering. As a result, it may be desirable to consider and account for dimensional shrinkage when designing tooling (molds, dies, etc.) or machining features in structures that are less than fully sintered.

According to some implementations of the present invention, the time and/or temperature of the infiltration process can be increased to allow the binder to fill-up a great number and greater amount of the pores of the matrix. This can both reduce the shrinkage during sintering, and increase the strength of the resulting drilling tool.

The present invention can thus be embodied in other specific forms without departing from its spirit or essential characteristics. The described embodiments are to be considered in all respects only as illustrative and not restrictive. For example, in some implementations of the present invention, the axially-tapered waterways can be formed by removing material from the crown instead of using plugs. Thus, in some implementations, the axially-tapered waterways can be formed by machining or cutting the waterways into the crown using water jets, lasers, Electrical Discharge Machining (EDM), or other techniques. The scope of the invention is, therefore, indicated by the appended claims rather than by the foregoing description. All changes that come within the meaning and range of equivalency of the claims are to be embraced within their scope.

We claim:

1. A core-sampling drill bit, comprising:

a shank;

an annular crown including a longitudinal axis therethrough, a cutting face, an inner surface, and an outer surface, said annular crown defining an interior space about the longitudinal axis configured to receive a core sample; and at least one waterway extending from said inner surface to said outer surface, wherein each waterway of said at least one waterway is axially tapered whereby each waterway of said at least one waterway has a variable longitudinal dimension, wherein the longitudinal dimension of each waterway of said at least one waterway at said outer surface is greater than the longitudinal dimension of said waterway at said inner surface, wherein at least one waterway of said at least one waterway comprises an enclosed slot formed in said crown a first distance from said cutting face.

2. The core-sampling drill bit as recited in claim 1, wherein each waterway of said at least one waterway is radially tapered whereby each waterway of said at least one waterway has a variable width, wherein the width of each waterway of said at least one waterway is greater at said outer surface than the width of said waterway at said inner surface.

3. The core-sampling drill bit as recited in claim 2, wherein said at least one waterway comprises a plurality of waterways, and wherein at least one waterway of said plurality of waterways comprises a notch extending a second distance from said cutting face into said crown toward said shank.

4. The core-sampling drill bit as recited in claim 3, wherein said second distance is greater than said first distance.

5. The core-sampling drill bit as recited in claim 1, further comprising at least one inner flute extending from said inner surface toward said outer surface, each inner flute of said at least one inner flute extending axially along said inner surface from a respective waterway of said at least one waterway toward said shank.

6. The core-sampling drill bit as recited in claim 1, further comprising at least one outer flute extending from said outer surface toward said inner surface, each outer flute of said at least one outer flute extending axially along said outer surface from a respective waterway of said at least one waterway toward said shank.

7. The core-sampling drill bit as recited in claim 1, further comprising at least one fluid channel enclosed within said crown, each fluid channel of said at least one fluid channel extending from said shank to a respective waterway of said at least one waterway.

8. The core-sampling drill bit as recited in claim 7, further comprising a thin wall extending around said inner surface of said crown, wherein said thin wall separates said at least one waterway from said interior space.

9. A drilling tool, comprising:

a shank;

a cutting portion secured to said shank, said cutting portion including a cutting face, an inner surface, and an outer surface; and one or more waterways defined by a first side surface extending from said inner surface to said outer surface, an opposing second side surface extending from said inner surface to said outer surface, and a top surface extending between said first side surface and second side surface and from said inner surface to said outer surface, wherein said top surface tapers from said inner surface to said outer surface in a direction generally from said cutting face toward said shank, wherein said one or more waterways comprises at least one slot enclosed within said cutting portion, said at least one enclosed slot comprising a first enclosed slot, said first enclosed slot including a bottom surface a first distance from said cutting face, wherein said bottom surface extends from said inner surface to said outer surface and from said first side surface to said second side surface.

10. The drilling tool as recited in claim 9, wherein said first side surface tapers from said inner surface to said outer surface in a direction generally clockwise around said cutting portion when viewed from the cutting face of the shank.

11. The drilling tool as recited in claim 10, wherein said second side surface extends from said inner surface to said outer surface in a direction normal to said inner surface.

12. The drilling tool as recited in claim 9, wherein at least one of said one or more waterways comprises at least one notch extending from said cutting face into said cutting portion, said at least one notch comprising a first notch.

13. The drilling tool as recited in claim 12, wherein said first enclosed slot is circumferentially offset from said first notch.

14. The drilling tool as recited in claim 13, further comprising a second enclosed slot, wherein said second enclosed slot is circumferentially offset from said first notch and said first enclosed slot.

15. The drilling tool as recited in claim 14, wherein said second enclosed slot is axially offset from said first enclosed fluid slot.

16. The drilling tool as recited in claim 9, wherein said bottom surface tapers from said inner surface to said outer surface in a direction generally from said shank toward said cutting face.

17. An earth-boring drill bit, comprising:

a shank;

a crown secured to and extending away from said shank, said crown including a cutting face, an inner surface, and an outer surface; and a plurality of notches extending into said cutting face a first distance at said inner surface and extending into said cutting face a second distance at said outer surface, wherein said second distance is greater than said first distance, and wherein said plurality of notches extend from said inner surface to said outer surface; and at least one enclosed slot formed in said crown, each enclosed slot of said at least one enclosed slot being spaced from said cutting face.

18. The earth-boring drill bit as recited in claim 17, wherein said plurality of notches comprise a first generally axially extending surface, a second generally axially extending surface, and a generally radially extending surface extending between said first generally axially extending surface and said second generally axially extending surface.

19. The earth-boring drill bit as recited in claim 18, wherein said first generally axially extending surface extends from said inner surface to said outer surface in a direction normal to said inner surface.

20. The earth-boring drill bit as recited in claim 19, wherein said second generally axially extending surface is tapered whereby the circumferential distance from said first generally axially extending surface to said second generally axially extending surface at said inner surface comprises a third distance, and wherein the circumferential distance from said first generally axially extending surface to said second generally axially extending surface at said outer surface comprises a fourth distance, and wherein said fourth distance is greater than said third distance.

21. The earth-boring drill bit as recited in claim 17, further comprising a plurality of grooves extending axially into said cutting face between adjacent notches of said plurality of notches.

22. The earth-boring drill bit as recited in claim 17, further comprising a plurality of flutes extending from said inner surface toward said outer surface, each flute of said plurality of flutes extending along said inner surface from said shank to a respective notch of said plurality of notches.

23. A drilling system, comprising:

a drill rig;

a drill string adapted to be secured to and rotated by said drill rig; and a drill bit adapted to be secured to said drill string, said drill bit comprising a shank, an annular crown including a longitudinal axis therethrough, a cutting face, an inner surface, and an outer surface, said annular crown defining an interior space about the longitudinal axis configured to receive a core sample, and at least one waterway extending from said inner surface to said outer surface, wherein each waterway of said at least one waterway is axially tapered whereby each waterway of said at least one waterway has a variable longitudinal dimension, wherein the longitudinal dimension of each waterway of said at least one waterway at said outer surface is greater than the longitudinal dimension of said at least one waterway at said inner surface wherein at least one waterway of said at least one waterway comprises an enclosed slot formed in said crown a first distance from said cutting face.

24. The drilling system of claim 23, wherein each waterway of said at least one waterway is radially tapered whereby each waterway of said at least one waterway has a variable width, wherein the width of each waterway of said at least one waterway is greater at said outer surface than the width of said waterway at said inner surface.

25. The drilling system as recited in claim 23, wherein said at least one waterway comprises a plurality of waterways, and wherein at least one waterway of said plurality of waterways comprises a notch extending a second distance from said cutting face into said crown.

26. The drilling system as recited in claim 25, wherein said second distance is greater than said first distance.

27. The drilling system as recited in claim 23, wherein the drill bit further comprises at least one inner flute extending from said inner surface toward said outer surface, each inner flute of said at least one inner flute extending axially along said inner surface from a respective waterway of said at least one waterway toward said shank.

28. The drilling system as recited in claim 23, wherein the drill bit further comprises at least one outer flute extending from said outer surface toward said inner surface, each outer flute of said at least one outer flute extending axially along said outer surface from a respective waterway of said at least one waterway toward said shank.

* * * * *